US010113776B2

(12) United States Patent
Chaudhry et al.

(10) Patent No.: US 10,113,776 B2
(45) Date of Patent: Oct. 30, 2018

(54) PACKAGED TERMINAL AIR CONDITIONER UNIT

(71) Applicant: Haier US Appliance Solutions, Inc., Wilmington, DE (US)

(72) Inventors: Gunaranjan Chaudhry, Bangalore (IN); Brent Alden Junge, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 28 days.

(21) Appl. No.: 15/214,503

(22) Filed: Jul. 20, 2016

(65) Prior Publication Data

US 2018/0023850 A1 Jan. 25, 2018

(51) Int. Cl.

| | |
|---|---|
| ***F25B 13/00*** | (2006.01) |
| ***F25B 41/04*** | (2006.01) |
| ***F24F 13/30*** | (2006.01) |
| ***F25B 5/02*** | (2006.01) |
| ***F24F 1/02*** | (2011.01) |
| ***F24F 13/20*** | (2006.01) |
| ***F25B 5/04*** | (2006.01) |
| ***F25B 41/00*** | (2006.01) |

(52) U.S. Cl.

CPC ..... *F25B 13/00* (2013.01); *F24F 1/027* (2013.01); *F24F 13/20* (2013.01); *F24F 13/30* (2013.01); *F25B 5/04* (2013.01); *F25B 41/00* (2013.01); *F25B 2341/0012* (2013.01); *F25B 2400/0407* (2013.01); *F25B 2400/23* (2013.01)

(58) Field of Classification Search

CPC .. F25B 13/00; F25B 41/00; F25B 5/04; F25B 2400/0407; F25B 2341/0012; F25B 2400/23; F24F 13/20; F24F 1/027; F24F 13/30

See application file for complete search history.

(56) References Cited

U.S. PATENT DOCUMENTS

| | | | | |
|---|---|---|---|---|
| 2006/0266072 | A1* | 11/2006 | Takeuchi | F25B 40/00 62/500 |
| 2011/0005268 | A1* | 1/2011 | Oshitani | F25B 41/00 62/500 |
| 2012/0036854 | A1* | 2/2012 | Vaisman | F01K 17/02 60/671 |
| 2015/0143836 | A1 | 5/2015 | Junge | |
| 2015/0300710 | A1 | 10/2015 | Junge et al. | |

(Continued)

FOREIGN PATENT DOCUMENTS

| | | | |
|---|---|---|---|
| CN | 102141316 | A | 8/2011 |
| DE | 102005021396 | A1 | 11/2006 |

(Continued)

*Primary Examiner* — Kun Kai Ma

(74) *Attorney, Agent, or Firm* — Dority & Manning, P.A.

(57) ABSTRACT

A packaged terminal air conditioner unit is provided. The packaged terminal air conditioner unit includes a casing. A compressor, an interior coil, an exterior coil and a reversing valve are positioned within the casing. The reversing valve is configured for selectively reversing a flow direction of compressed refrigerant from the compressor. The packaged terminal air conditioner also includes at least one ejector for combining a stream of refrigerant from a primary loop with a stream of refrigerant from an auxiliary cooling loop, thereby improving system efficiency.

13 Claims, 15 Drawing Sheets

(56) References Cited

U.S. PATENT DOCUMENTS

| | | | | |
|---|---|---|---|---|
| 2016/0109160 | A1 | 4/2016 | Junge et al. | |
| 2016/0313013 | A1* | 10/2016 | Chaudhry | F24F 1/027 |
| 2017/0003040 | A1* | 1/2017 | Chaudhry | F25B 13/00 |
| 2017/0102170 | A1* | 4/2017 | Wang | F25B 9/008 |
| 2017/0248350 | A1* | 8/2017 | Liu | F25B 13/00 |

FOREIGN PATENT DOCUMENTS

| | | | |
|---|---|---|---|
| JP | 2004150692 | A | 5/2004 |
| JP | 2007147198 | A | 6/2007 |

* cited by examiner

PACKAGED TERMINAL AIR CONDITIONER UNIT

FIELD OF THE INVENTION

The present subject matter relates generally to heat pump systems, such as packaged terminal air conditioner units, and sealed systems for the same.

BACKGROUND OF THE INVENTION

Certain packaged terminal air conditioner units (PTACs) include a sealed system for chilling and/or heating air. The sealed systems include various components for treating a refrigerant in order to cool or heat air. The sealed system components are generally positioned within a casing that can be mounted within a wall or window of an associated building. Due to space constraints within the casing, selection of sealed system components for packaged terminal air conditioner units can be limited to relatively small components.

Packaged terminal air conditioner units are frequently classified and sold by efficiency. Customers generally prefer efficient packaged terminal air conditioner units because small improvements in heating and cooling efficiency can provide a significant reduction in utility bills. Energy efficiency in packaged terminal air conditioner units is generally a function of compressor size and efficiency, heat exchanger size, design, and airflow, and fan design among other factors. However, high efficiency compressors are typically very expensive, and large heat exchangers may not fit within the limited space available in the casing of a packaged terminal air conditioner unit.

Accordingly, a packaged terminal air conditioner unit with features for assisting with increasing an efficiency of the packaged terminal air conditioner would be useful. In particular, a packaged terminal air conditioner unit with features for assisting with increasing an efficiency of the packaged terminal air conditioner without requiring a high efficiency compressor and/or a large heat exchanger would be useful.

BRIEF DESCRIPTION OF THE INVENTION

The present subject matter provides a packaged terminal air conditioner unit. The packaged terminal air conditioner unit includes a casing. A compressor, an interior coil, an exterior coil and a reversing valve are positioned within the casing. The reversing valve is configured for selectively reversing a flow direction of compressed refrigerant from the compressor. The packaged terminal air conditioner also includes at least one ejector for combining a stream of refrigerant from a primary loop with a stream of refrigerant from an auxiliary cooling loop, thereby improving system efficiency. Additional aspects and advantages of the invention will be set forth in part in the following description, or may be apparent from the description, or may be learned through practice of the invention.

In a first exemplary embodiment, a packaged terminal air conditioner unit is provided. The packaged terminal air conditioner unit includes a casing extending between an exterior side portion and an interior side portion. A compressor is positioned within the casing, the compressor being operable to compress a refrigerant. An exterior coil is positioned within the casing at the exterior side portion of the casing, a primary interior coil is positioned within the casing at the interior side portion of the casing and a secondary interior coil is positioned within the casing at the interior side portion of the casing. A reversing valve is positioned within the casing, the reversing valve being in fluid communication with the compressor in order to receive compressed refrigerant from the compressor and selectively direct the compressed refrigerant from the compressor. An ejector is configured for combining two or more streams of refrigerant. A primary loop has a first portion extending between the reversing valve and the exterior coil, a second portion extending between the exterior coil and the ejector, a third portion extending between the ejector and the primary interior coil, and a fourth portion extending between the primary interior coil and the reversing valve. An auxiliary loop conduit has a first portion extending between the third portion of the primary loop and the secondary interior coil, a second portion extending between the secondary interior coil and the second portion of the primary loop, and a third portion extending between the secondary interior coil and the ejector.

In a second exemplary embodiment, a packaged terminal air conditioner unit is provided. The packaged terminal air conditioner unit includes a casing extending between an exterior side portion and an interior side portion. A compressor is positioned within the casing, the compressor being operable to compress a refrigerant. An exterior coil is positioned within the casing at the exterior side portion of the casing, a primary interior coil is positioned within the casing at the interior side portion of the casing and a secondary interior coil is positioned within the casing at the interior side portion of the casing. A reversing valve is positioned within the casing, the reversing valve being in fluid communication with the compressor in order to receive compressed refrigerant from the compressor and selectively direct the compressed refrigerant from the compressor. An ejector is configured for combining two or more streams of refrigerant. A primary loop has a first portion extending between the reversing valve and the exterior coil, a second portion extending between the exterior coil and the ejector, a third portion extending between the ejector and the primary interior coil, and a fourth portion extending between the primary interior coil and the reversing valve. An auxiliary loop conduit has a first portion extending between the third portion of the primary loop and the secondary interior coil, and a second portion extending between the secondary interior coil and the ejector. The second portion of the primary loop comprises a check valve configured to prevent the flow of refrigerant back in to the exterior coil and an expansion device plumbed in parallel.

In a third exemplary embodiment, a packaged terminal air conditioner unit is provided. The packaged terminal air conditioner unit includes a casing extending between an exterior side portion and an interior side portion. A compressor is positioned within the casing, the compressor being operable to compress a refrigerant. An exterior coil is positioned within the casing at the exterior side portion of the casing, a primary interior coil is positioned within the casing at the interior side portion of the casing and a secondary interior coil is positioned within the casing at the interior side portion of the casing. A reversing valve is positioned within the casing, the reversing valve being in fluid communication with the compressor in order to receive compressed refrigerant from the compressor and selectively direct the compressed refrigerant from the compressor. An ejector is configured for combining two or more streams of refrigerant. A primary loop has a first portion extending between the reversing valve and the exterior coil, a second portion extending between the exterior coil and the ejector, a third portion extending between the ejector and the primary interior coil, and a fourth portion extending between the primary interior coil and the reversing valve. An auxiliary loop conduit has a first portion extending between the third portion of the primary loop and a three-way valve, a second portion extending between the three way valve and the secondary interior coil, a third portion extending between the secondary interior coil and the ejector, and a fourth portion extending between the three-way valve and the second portion of the primary loop.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
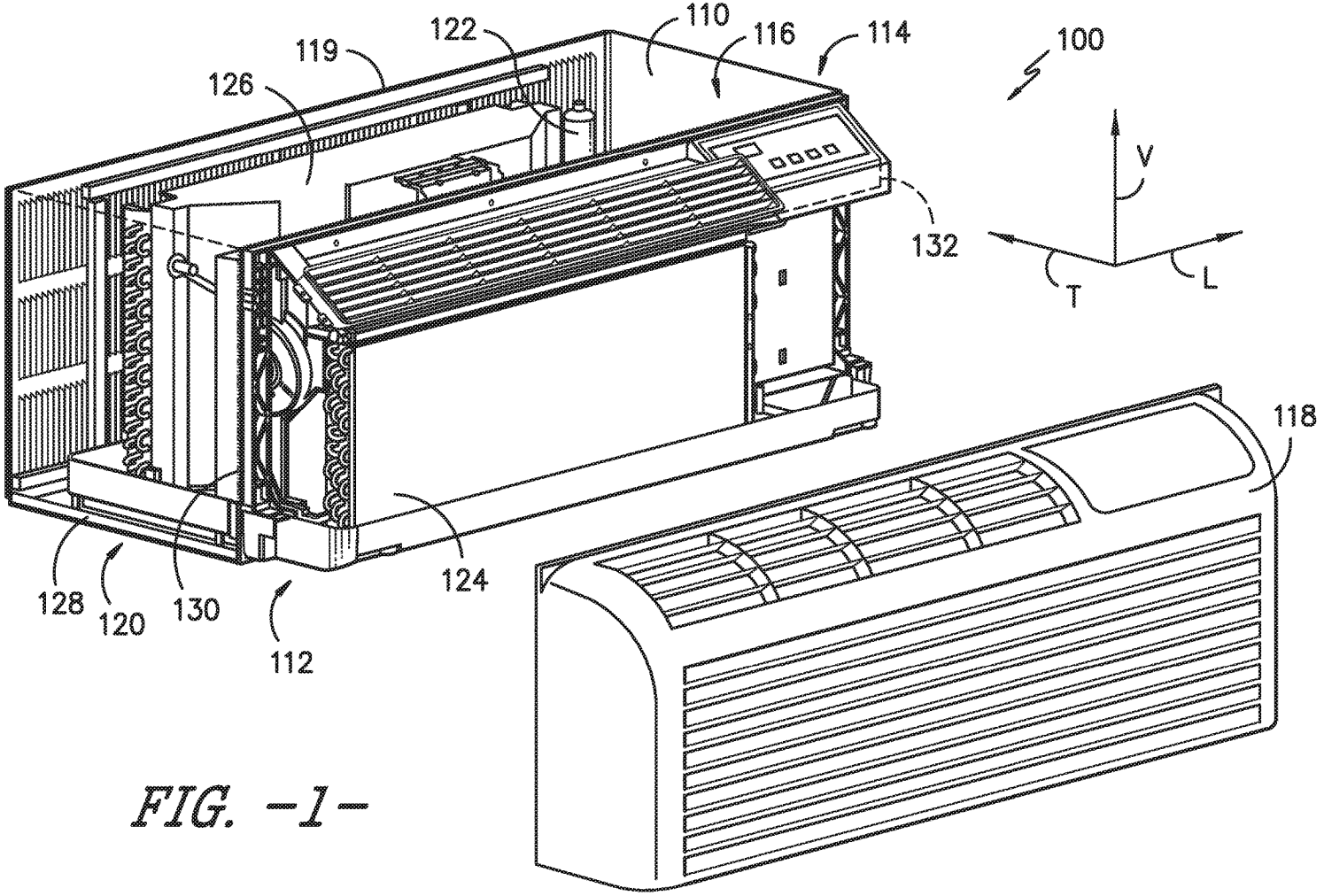
FIG. 1 provides an exploded perspective view of a packaged terminal air conditioner unit according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exploded perspective view of a packaged terminal air conditioner unit 100 according to an exemplary embodiment of the present subject matter. Packaged terminal air conditioner unit 100 is operable to generate chilled and/or heated air in order to regulate the temperature of an associated room or building. As will be understood by those skilled in the art, packaged terminal air conditioner unit 100 may be utilized in installations where split heat pump systems are inconvenient or impractical. As discussed in greater detail below, a sealed system 120 of packaged terminal air conditioner unit 100 is disposed within a casing 110. Thus, packaged terminal air conditioner unit 100 may be a self-contained or autonomous system for heating and/or cooling air.

As may be seen in FIG. 1, casing 110 extends between an interior side portion 112 and an exterior side portion 114. Interior side portion 112 of casing 110 and exterior side portion 114 of casing 110 are spaced apart from each other. Thus, interior side portion 112 of casing 110 may be positioned at or contiguous with an interior atmosphere, and exterior side portion 114 of casing 110 may be positioned at or contiguous with an exterior atmosphere. Sealed system 120 includes components for transferring heat between the exterior atmosphere and the interior atmosphere. For example, sealed system 120 includes a compressor 122, an interior heat exchanger or coil 124 and an exterior heat exchanger or coil 126.

Casing 110 defines a mechanical compartment 116. Sealed system 120 is disposed or positioned within mechanical compartment 116 of casing 110. A front panel 118 and a rear grill or screen 119 are mounted to casing 110 and hinder or limit access to mechanical compartment 116 of casing 110. Front panel 118 is mounted to casing 110 at interior side portion 112 of casing 110, and rear screen 119 is mounted to casing 110 at exterior side portion 114 of casing 110. Front panel 118 and rear screen 119 each define a plurality of holes that permit air to flow through front panel 118 and rear screen 119, with the holes sized for preventing foreign objects from passing through front panel 118 and rear screen 119 into mechanical compartment 116 of casing 110.

Packaged terminal air conditioner unit 100 also includes a drain pan or bottom tray 128 and an inner wall 130 positioned within mechanical compartment 116 of casing 110. Sealed system 120 is positioned on bottom tray 128. Thus, liquid runoff from sealed system 120 may flow into and collect within bottom tray 128. Inner wall 130 may be mounted to bottom tray 128 and extend upwardly from bottom tray 128 to a top wall of casing 110. Inner wall 130 limits or prevents air flow between interior side portion 112 of casing 110 and exterior side portion 114 of casing 110 within mechanical compartment 116 of casing 110. Thus, inner wall 130 may divide mechanical compartment 116 of casing 110.

Packaged terminal air conditioner unit 100 further includes a controller 132 with user inputs, such as buttons, switches and/or dials. Controller 132 regulates operation of packaged terminal air conditioner unit 100. Thus, controller 132 is in operative communication with various components of packaged terminal air conditioner unit 100, such as components of sealed system 120 and/or a temperature sensor, such as a thermistor or thermocouple, for measuring the temperature of the interior atmosphere. In particular, controller 132 may selectively activate sealed system 120 in order to chill or heat air within sealed system 120, e.g., in response to temperature measurements from the temperature sensor.

Controller 132 includes memory and one or more processing devices such as microprocessors, CPUs or the like, such as general or special purpose microprocessors operable to execute programming instructions or micro-control code associated with operation of packaged terminal air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 132 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
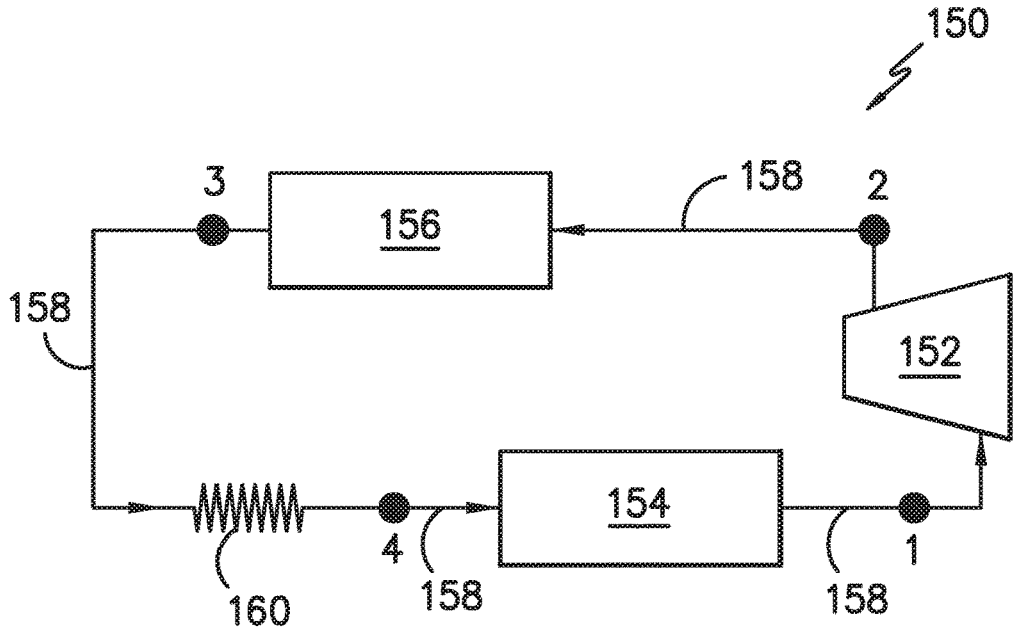
FIG. -2- PRIOR ART
FIGS. 2 and 3 provide a schematic view of components of a prior art sealed system for a packaged terminal air conditioner unit operating in a cooling mode and a corresponding pressure-enthalpy (P-h) diagram.

FIG. 2 provides a schematic view of components of a prior art sealed system 150 commonly used in a packaged terminal air conditioner unit. Sealed system 150 is shown operating in a cooling mode in FIG. 2, but may also operate in a heating mode (not shown). As illustrated, sealed system 150 includes a compressor 152, an interior heat exchanger or coil 154, and an exterior heat exchanger or coil 156. As is generally understood, various segments of any suitable tubing, piping, or conduit may be utilized to flow refrigerant between the various components of sealed system 150. Thus, for example, interior coil 154 and exterior coil 156 may be in fluid communication with each other and compressor 152 via suitable conduit 158. The unlabeled arrows in FIG. 2 indicate the direction of refrigerant flow within adjacent conduits 158 of sealed system 150 in the cooling mode.

Figure 3:
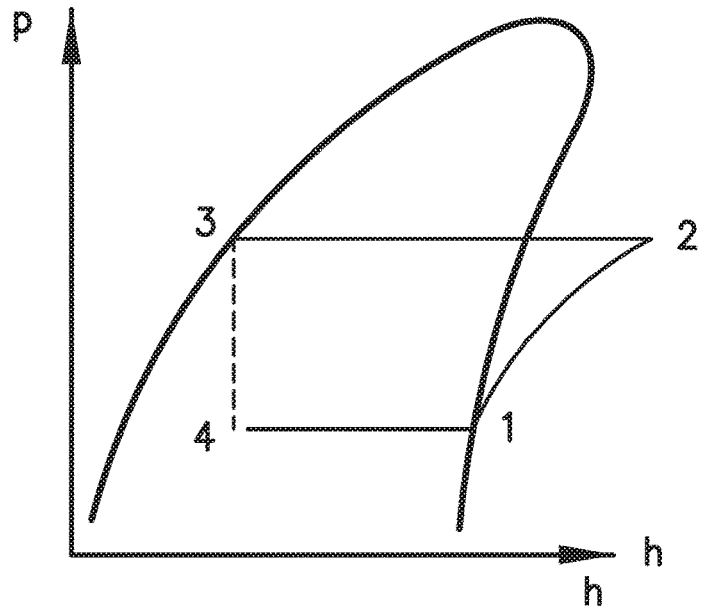

FIG. 3 provides a pressure-enthalpy (P-h) diagram that illustrates the relationship between the pressure (e.g., in kilopascals) and the enthalpy (e.g., in joules per kilogram) of refrigerant as it moves through sealed system 150. The numbers 1 through 4 on the P-h diagram identify the refrigerant properties when the refrigerant is at the location identified by the identical number in the sealed system schematic of FIG. 2. This numbering scheme is used throughout the figures to correlate the refrigerant properties to various locations within the exemplary sealed systems. One skilled in the art will appreciate that the pressure-enthalpy relationship shown is only exemplary and is used for the purpose of comparing prior art sealed system 150 with sealed systems according to exemplary embodiments of the present subject matter that will be described in detail below.

During operation of sealed system 150, compressor 152 operates to increase a pressure of the refrigerant within compressor 152. In particular, vapor refrigerant from interior coil 154 is directed to compressor 152 in the cooling mode. Vapor refrigerant from interior coil 154 may be a fluid in the form of a superheated vapor. Upon exiting interior coil 154, the refrigerant may enter compressor 152, and compressor 152 may operate to compress the refrigerant. Accordingly, the pressure and temperature of the refrigerant may be increased in compressor 152 such that the refrigerant becomes a more high-pressure superheated vapor.

Exterior coil 156 is disposed downstream of compressor 152, and when sealed system 150 is operating in the cooling mode, exterior coil 156 acts as a condenser. Thus, exterior coil 156 is operable to reject heat into the exterior atmosphere, e.g., at exterior side portion 114 of casing 110, when sealed system 150 is operating in the cooling mode. For example, the superheated vapor from compressor 152 may enter exterior coil 156 via suitable conduit or piping 158 that extends between and fluidly connects compressor 152 and exterior coil 156. Within exterior coil 156, the refrigerant from compressor 152 transfers energy to the exterior atmosphere and condenses into a saturated liquid, a liquid-vapor mixture, and/or a subcooled liquid. An exterior air handler or fan (not shown) may be positioned adjacent exterior coil 156 to facilitate or urge a flow of air from the exterior atmosphere across exterior coil 156 in order to facilitate heat transfer.

An expansion device 160 is disposed on conduit 158 between exterior coil 156 and interior coil 154. In the cooling mode, liquid refrigerant from exterior coil 156 travels through expansion device 160 before flowing through interior coil 154. Expansion device 160 may generally expand the refrigerant, thereby lowering its pressure and temperature. The refrigerant may then be flowed through interior coil 154.

As used herein, expansion device may refer to any device suitable for throttling or expanding the refrigerant flowing through a conduit. For example, according to the illustrated embodiment, expansion device 160 is a capillary tube that allows refrigerant to expand after leaving exterior coil 156 prior to entering interior coil 154. According to other exemplary embodiments, expansion device 160 may be a J-T valve or an electronic expansion valve that enables controlled expansion of refrigerant. In this regard, expansion device 160 may be configured to precisely control the expansion of refrigerant to maintain, for example, a desired temperature differential of the refrigerant across the interior coil 154 or exterior coil 156, or to ensure that the refrigerant is in the gaseous state prior to entering compressor 152. Other types, configurations, and locations of expansion devices are possible and within the scope of the present subject matter.

Interior coil 154 is disposed on conduit 158 between expansion device 160 and compressor 152. In this manner, when sealed system 150 is operating in the cooling mode, interior coil 154 is disposed downstream of expansion device 160 and acts as an evaporator. Thus, interior coil 154 is operable to heat refrigerant within interior coil 154 with energy from the interior atmosphere, e.g., at interior side portion 112 of casing 110, when sealed system 150 is operating in the cooling mode. For example, within interior coil 154, the refrigerant from expansion device 160 receives energy from the interior atmosphere and vaporizes into superheated vapor and/or high quality vapor mixture. An interior air handler or fan (not shown) may be positioned adjacent interior coil 154 to facilitate or urge a flow of air from the interior atmosphere across interior coil 154 in order to facilitate heat transfer.

During operation of sealed system 150 in the heating mode, a reversing valve (not shown) reverses the direction of refrigerant flow through sealed system 150. Thus, in the heating mode, interior coil 154 is disposed downstream of compressor 152 and acts as a condenser, e.g., such that interior coil 154 is operable to reject heat into the interior atmosphere at interior side portion 112 of casing 110. The refrigerant from interior coil 154 travels through expansion device 160, which may generally expand the refrigerant, thereby lowering its pressure and temperature, as described above. The refrigerant may then flow through exterior coil 156.

Exterior coil 156 is disposed on conduit 158 between expansion device 160 and compressor 152. In this manner, when sealed system 150 is operating in the heating mode, exterior coil 156 is disposed downstream of expansion device 160 and acts as an evaporator. Thus, exterior coil 156 is operable to heat refrigerant within exterior coil 156 with energy from the exterior atmosphere, e.g., at exterior side portion 114 of casing 110, when sealed system 150 is operating in the heating mode. For example, within exterior coil 156, the refrigerant from expansion device 160 receives energy from the exterior atmosphere and vaporizes into superheated vapor and/or high quality vapor mixture. From exterior coil 156, refrigerant is directed back to compressor 152, and the heat pump cycle may be repeated.

Figure 4:
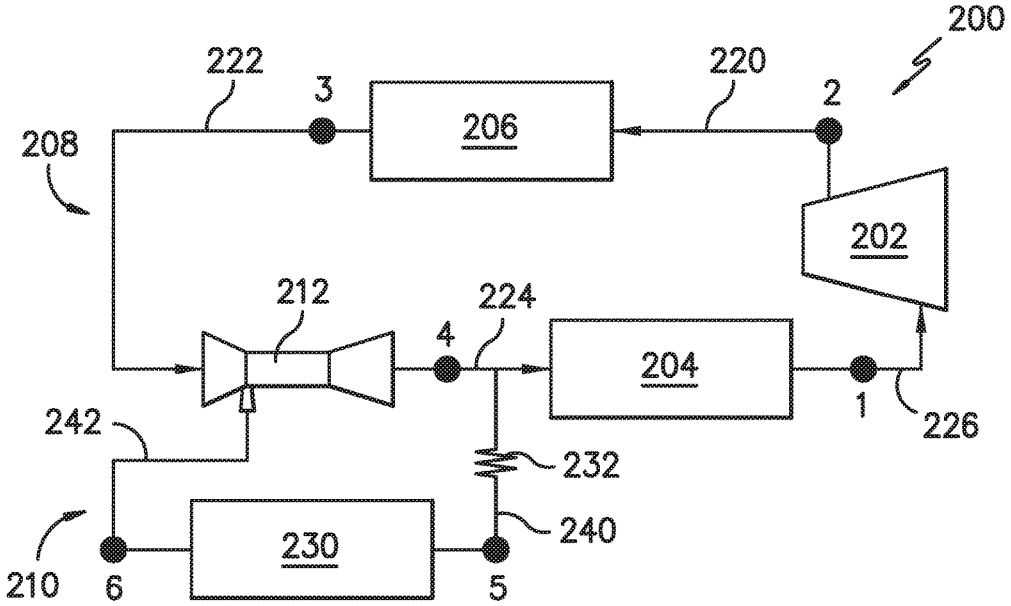
FIG. -4- PRIOR ART
FIGS. 4 and 5 provide a schematic view of components of a prior art sealed system for an air conditioning cycle and a corresponding pressure-enthalpy (P-h) diagram.
Figure 5:
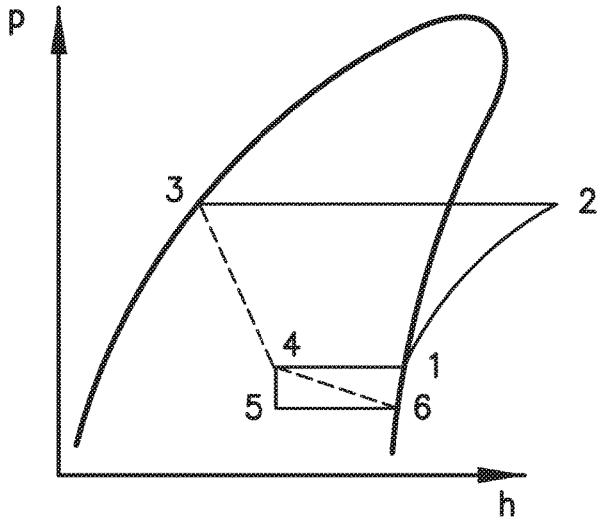

FIG. 4 provides a schematic view of components of a sealed system 200 commonly used to perform an air conditioning cycle. FIG. 5 provides a pressure-enthalpy (P-h) diagram that illustrates the relationship between the pressure (e.g., in kilopascals) and the enthalpy (e.g., in joules per kilogram) of refrigerant as it moves through sealed system 200. Sealed system 200 may be used in vehicle air conditioning systems. Sealed system 200 is shown operating in a cooling mode in FIG. 4. The unlabeled arrows in FIG. 4 indicate the direction of refrigerant flow within adjacent conduits or piping of sealed system 200 in the cooling mode.

Like sealed system 150 (FIG. 2), sealed system 200 generally operates in a refrigeration cycle. Sealed system 200 includes similar components to sealed system 150 and operates in a similar manner. For example, sealed system 200 includes a compressor 202, a primary interior heat exchanger or coil 204, an exterior heat exchanger or coil 206, and a conduit that operably couples the various components of sealed system 200. The loop of conduit that operably couples the components of sealed system 150 may be generally referred to herein as the primary loop 208 of conduit. However, sealed system 200 also includes an auxiliary cooling loop 210 including an ejector 212 that replaces expansion device 160 from sealed system 150, as described in detail below.

More specifically, compressor 202 and exterior coil 206 may be fluidly coupled by a first portion 220 of primary loop 208, exterior coil 206 and ejector 212 may be fluidly coupled by a second portion 222 of primary loop 208, ejector 212 and primary interior coil 204 may be fluidly coupled by a third portion 224 of primary loop 208, and primary interior coil 204 may be fluidly coupled with compressor 202 by a fourth portion 226 of primary loop 208.

As shown in FIG. 4, auxiliary loop 210 includes ejector 212, a secondary interior coil 230, and an expansion device 232. Ejector 212 is coupled to exterior coil 206 via second portion 222 of primary loop 208 and is coupled to primary interior coil 204 via third portion 224 of primary loop 208. Auxiliary loop 210 splits off third portion 224 of primary loop 208. A first portion 240 of auxiliary loop 210 fluidly couples third portion 224 of primary loop 208 and secondary interior coil 230. Expansion device 232 may be coupled to first portion 240 of auxiliary loop 210. Secondary interior coil 230 is fluidly coupled to ejector 212 via a second portion 242 of auxiliary loop 210.

In this manner, when sealed system 200 is operating, the flow of refrigerant from compressor 202 through ejector 212 entrains vapor phase refrigerant from auxiliary loop 210, i.e., via secondary interior coil 230. In particular, ejector 212 may be configured for combining streams of refrigerant via the Venturi effect or any other suitable means. Ejector 212 is positioned between second portion 222 and third portion 224 of primary loop and receives vapor phase refrigerant from secondary interior coil 230 via second portion 242 of auxiliary loop 210 that extends between and fluidly connects secondary interior coil 230 and ejector 212. Ejector 212 directs or urges the vapor phase refrigerant from second portion 242 of auxiliary loop 210 and refrigerant flowing through second portion 222 of primary loop 208 into third portion 224 of primary loop 208.

As illustrated in FIG. 5, sealed system 200 may operate at an improved energy efficiency ratio (EER) relative to sealed system 150. For example, ejector 212 of sealed system 200 may utilize expansion work of high-pressure refrigerant to drive refrigerant through a low temperature evaporative loop. In such a manner, ejector 212 may assist with reducing energy consumption of compressor 202. More specifically, by replacing the expansion device from a conventional heat pump cycle (FIG. 2) with an ejector 212 and auxiliary cooling loop 210, as described herein, sealed system 200 may achieve same amount of cooling (thermodynamically speaking), but part of the cooling is at a lower temperature (reference numeral 5 in FIG. 5). Thus, the total rate of evaporative heat transfer is higher since the heat transfer rate increases with decreasing average refrigerant temperature. In addition, compressor 202 will have to do more work to increase the pressure of refrigerant between primary interior coil 204 and exterior coil 206 (i.e., from reference numeral 1 to 2) under conventional system (FIG. 2) than in sealed system 200 including ejector 212 and auxiliary loop 210 (FIG. 4).

Figure 6:
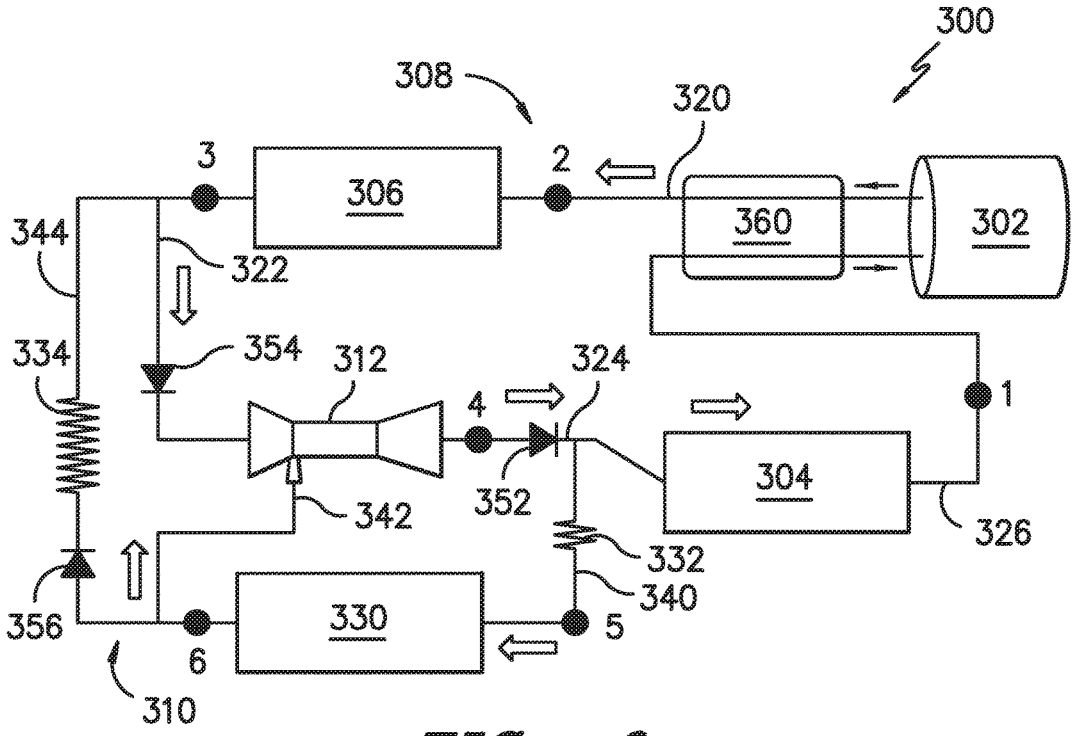
FIGS. 6 and 7 provide a schematic view of components of a sealed system for a packaged terminal air conditioner unit according to an exemplary embodiment of the present subject matter operating in a cooling mode and a corresponding pressure-enthalpy (P-h) diagram.
Figure 7:
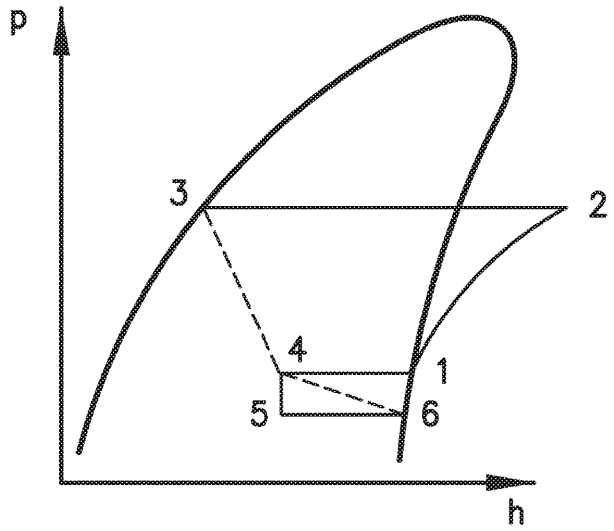
Figure 8:
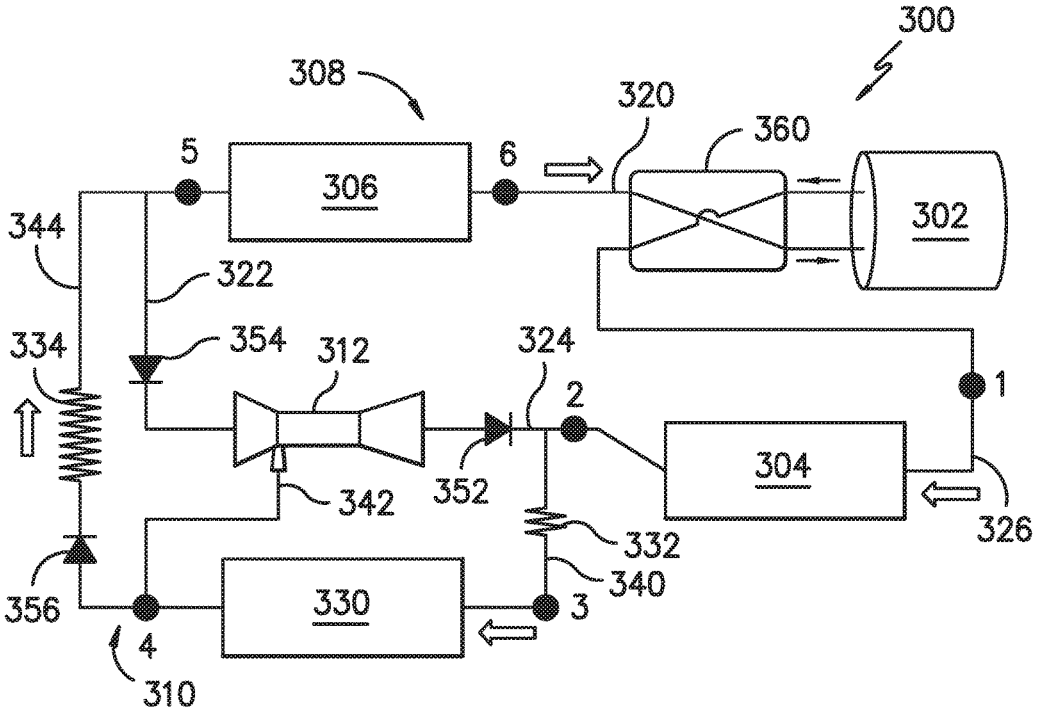
FIGS. 8 and 9 provide a schematic view of components of the exemplary sealed system of FIG. 6 operating in a heating mode and a corresponding pressure-enthalpy (P-h) diagram.
Figure 9:
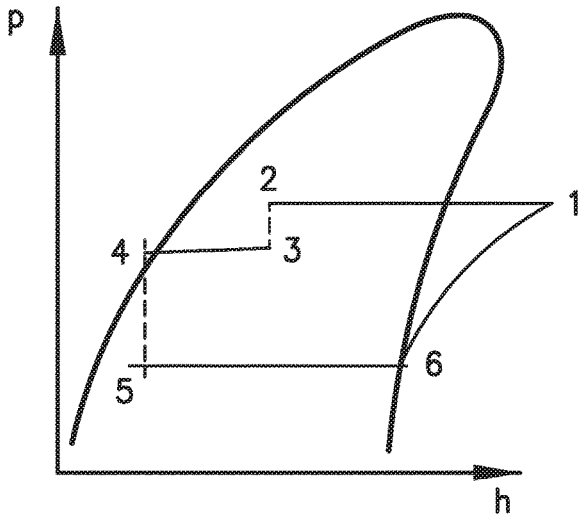

FIGS. 6 through 9 illustrate the sealed system schematic and refrigerant properties, in both a heating mode and a cooling mode, of a sealed system 300 for a packaged terminal air conditioner unit according to an exemplary embodiment of the present subject matter. More particularly, FIGS. 6 and 8 provide a schematic view of components of sealed system 300 when sealed system 300 is operating the cooling mode and the heating mode, respectively. FIGS. 7 and 9 provide pressure-enthalpy (P-h) diagrams that illustrate the relationship between the pressure (e.g., in kilopascals) and the enthalpy (e.g., in joules per kilogram) of refrigerant as sealed system 300 operates in the cooling mode and the heating mode, respectively.

Sealed system 300 may be used with or in any suitable packaged terminal air conditioner unit. For example, sealed system 300 may be used in packaged terminal air conditioner unit 100 (FIG. 1) as sealed system 120. The unlabeled arrows in FIGS. 6 and 8 indicate the direction of refrigerant flow within adjacent conduits or piping of sealed system 300 in the cooling mode and heating mode, respectively.

Sealed system 300 generally operates in either a refrigeration cycle or a heat pump cycle. Sealed system 300 includes similar components to sealed system 200 and operates in a similar manner. For example, sealed system 300 includes a compressor 302, a primary interior heat exchanger or coil 304, an exterior heat exchanger or coil 306, and a primary loop 308 of conduit that operably couples these components. Sealed system 300 also includes an auxiliary cooling loop 310 including an ejector 312 and several additional components configured to control the flow and behavior of the refrigerant within sealed system 300, as described below.

Primary loop 308 includes a plurality of piping or conduit sections that connect or fluidly couple various components of sealed system 300. More specifically, compressor 302 and exterior coil 306 may be fluidly coupled by a first portion 320 of primary loop 308, exterior coil 306 and ejector 312 may be fluidly coupled by a second portion 322 of primary loop 308, ejector 312 and primary interior coil 304 may be fluidly coupled by a third portion 324 of primary loop 308, and primary interior coil 304 may be fluidly coupled with compressor 302 by a fourth portion 326 of primary loop 308.

As shown in FIG. 6, auxiliary loop 310 includes ejector 312, a secondary interior coil 330, a first expansion device 332, and a second expansion device 334. Similar to primary loop 308, auxiliary loop 310 includes a plurality of piping or conduit sections that connect or fluidly couple various components of the auxiliary cooling loop 310. For example, a first portion 340 of auxiliary loop 310 splits off third portion 324 of primary loop 308 and fluidly couples third portion 324 of primary loop 308 and secondary interior coil 330. First expansion device 332 may be coupled to first portion 340 of auxiliary loop 310. A second portion 342 of auxiliary loop 310 fluidly couples secondary interior coil 330 with ejector 312. Second portion 322 of primary loop 308 is fluidly coupled to secondary interior coil 330 by a third portion 344 of auxiliary loop 310. Second expansion device 334 may be coupled to third portion 344 of auxiliary loop 310.

Sealed system 300 may further include one or more one-way valves, e.g., check valves, that are positioned on primary loop 308 or auxiliary loop 310 to prevent the flow of refrigerant in a particular direction. More specifically, as shown in FIGS. 6 and 8, a first check valve 352 may be coupled to third portion 324 of primary loop 308, i.e., downstream of ejector 312 when in the cooling mode but upstream of the junction where auxiliary loop 310 splits off primary loop 308. In this manner, first check valve 352 prevents the flow of refrigerant back into ejector 312 from primary interior coil 304 and from auxiliary loop 310.

A second check valve 354 may be coupled to second portion 322 of primary loop 308 between exterior coil 306 and ejector 312, i.e., upstream of ejector 312 when in the cooling mode. In this manner, second check valve 354 prevents the flow of refrigerant back into exterior coil 306 from ejector 312.

A third check valve 356 may be coupled to third portion 344 of auxiliary loop 310, i.e., downstream of secondary interior coil 330 when in the cooling mode. In this manner, third check valve 356 prevents the flow of refrigerant back into secondary interior coil 330 from exterior coil 306.

As may be seen in FIGS. 6 and 8, sealed system 300 also includes a reversing valve 360. Reversing valve 360 selectively directs compressed refrigerant from compressor 302 towards either primary interior coil 304 or exterior coil 306. More specifically, in the cooling mode (shown in FIG. 6), reversing valve 360 is arranged or configured to direct compressed refrigerant from compressor 302 to or towards exterior coil 306. Conversely, in the heating mode (shown in FIG. 8), reversing valve 360 is arranged or configured to direct compressed refrigerant from compressor 302 to or towards primary interior coil 304. Thus, reversing valve 360 permits sealed system 300 to adjust between the heating mode and the cooling mode, as will be understood by those skilled in the art.

As shown in FIG. 6, when sealed system 300 is operating in the cooling mode, reversing valve 360 is configured to direct compressed refrigerant from compressor 302 directly to exterior coil 306. Exterior coil 306 acts as a condenser and rejects heat into the exterior atmosphere at exterior side portion 114 of casing 110. For example, the superheated vapor from compressor 302 may pass through exterior coil 306, transfer energy to the exterior atmosphere, and condense into a saturated liquid, a liquid-vapor mixture, and/or a subcooled liquid. An exterior air handler or fan (not shown) may be positioned adjacent exterior coil 306 to facilitate or urge a flow of air from the exterior atmosphere across exterior coil 306 in order to facilitate heat transfer.

The refrigerant then flows through second portion 322 of primary loop 308 and into ejector 312. Notably, third check valve 356 prevents refrigerant from flowing through third portion 344 of auxiliary loop 310 toward secondary interior coil 330. The refrigerant passes through ejector 312, which combines a stream of refrigerant from primary loop 308 with a stream of refrigerant from auxiliary loop 310, thereby improving system efficiency as described above. More specifically, the flow of refrigerant from compressor 302 through ejector 312 entrains vapor phase refrigerant from auxiliary loop 310, i.e., via secondary interior coil 330. From ejector 312, the combined refrigerant stream is passed through both primary interior coil 304 (via third portion 324 of primary loop 308) and through secondary interior coil 330 (via first expansion device 332). In particular, ejector 312 may be configured for combining streams of refrigerant via the Venturi effect or any other suitable means.

Therefore, when sealed system 300 is operating in the cooling mode (FIG. 6), primary interior coil 304 is disposed downstream of ejector 312 and acts as an evaporator. Similarly, secondary interior coil 330 acts as a secondary evaporator within auxiliary loop 310. Thus, primary interior coil 304 and secondary interior coil 330 are operable to absorb heat from the interior atmosphere at interior side portion 112 of casing 110 when sealed system 300 is operating in the cooling mode. The refrigerant from ejector 312 receives energy and vaporizes into superheated vapor and/or high quality vapor mixture before passing to compressor 302. An interior air handler or fan (not shown) may be positioned adjacent primary interior coil 304 and/or secondary interior coil 330 to facilitate or urge a flow of air from the interior atmosphere across interior coils 304, 330 in order to facilitate heat transfer.

As shown in FIG. 8, when sealed system 300 is operating in the heating mode, reversing valve 360 is configured to direct compressed refrigerant from compressor 302 directly to primary interior coil 304. First check valve 352 and second check valve 354 are operable to prevent refrigerant from flowing through ejector 312 and through second portion 322 of primary loop 308. Therefore, refrigerant passes through primary interior coil 304, directly into auxiliary loop 310, and through secondary interior coil 330. In this manner, primary interior coil 304 and secondary interior coil 330 act as condensers and reject heat to the interior atmosphere at interior side portion 112 of casing 110 when sealed system 300 is operating in the heating mode. One or more interior air handlers or fans (not shown) may be positioned adjacent primary interior coil 304 and/or secondary interior coil 330 to facilitate or urge a flow of air from the interior atmosphere across interior coils 304, 330 in order to facilitate heat transfer.

Upon exiting secondary interior coil 330, refrigerant flows through third portion 344 of auxiliary loop 310 through the forward-biased third check valve 356 and second expansion device 334. Second expansion device 334 may generally expand the refrigerant, thereby lowering its pressure and temperature. The refrigerant may then be flowed through exterior coil 306.

When sealed system 300 is operating in the heating mode, exterior coil 306 acts as an evaporator and absorbs heat energy from the exterior atmosphere, e.g., at exterior side portion 114 of casing 110, when sealed system 300 is operating in the heating mode. For example, within exterior coil 306, the refrigerant from second expansion device 334 receives energy from the exterior atmosphere and vaporizes into superheated vapor and/or high quality vapor mixture. An exterior air handler or fan (not shown) may be positioned adjacent exterior coil 306 to facilitate or urge a flow of air from the exterior atmosphere across exterior coil 306 in order to facilitate heat transfer. From exterior coil 306, refrigerant is directed back to compressor 302, and the cycle is repeated.

In addition to the efficiency improvements described above with respect to sealed system 200, sealed system 300 may exhibit additional performance advantages. For example, sealed system 300 operates with ejector 312 and auxiliary cooling loop 310 in the cooling mode, but acts similar to a conventional sealed system (but with two evaporators) when operating in the heating mode. More specifically, in the heating mode, refrigerant flows through primary interior coil 304 and secondary interior coil 330 in series, thereby condensing and rejecting heat into the room.

Figure 10:
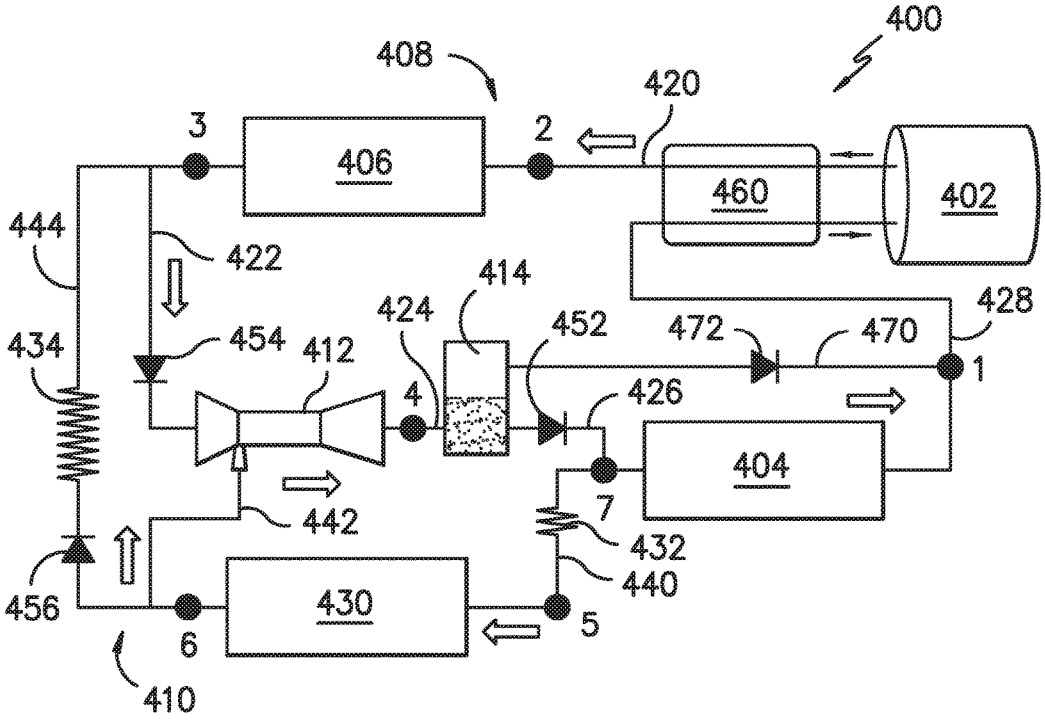
FIGS. 10 and 11 provide a schematic view of components of a sealed system for a packaged terminal air conditioner unit according to an exemplary embodiment of the present subject matter operating in a cooling mode and a corresponding pressure-enthalpy (P-h) diagram.
Figure 11:
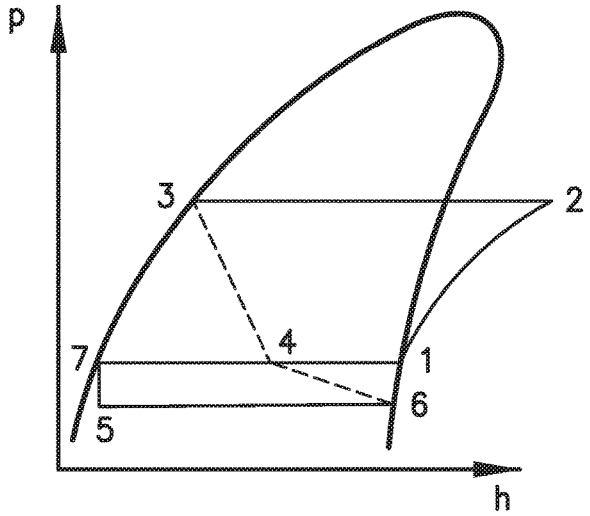
Figure 12:
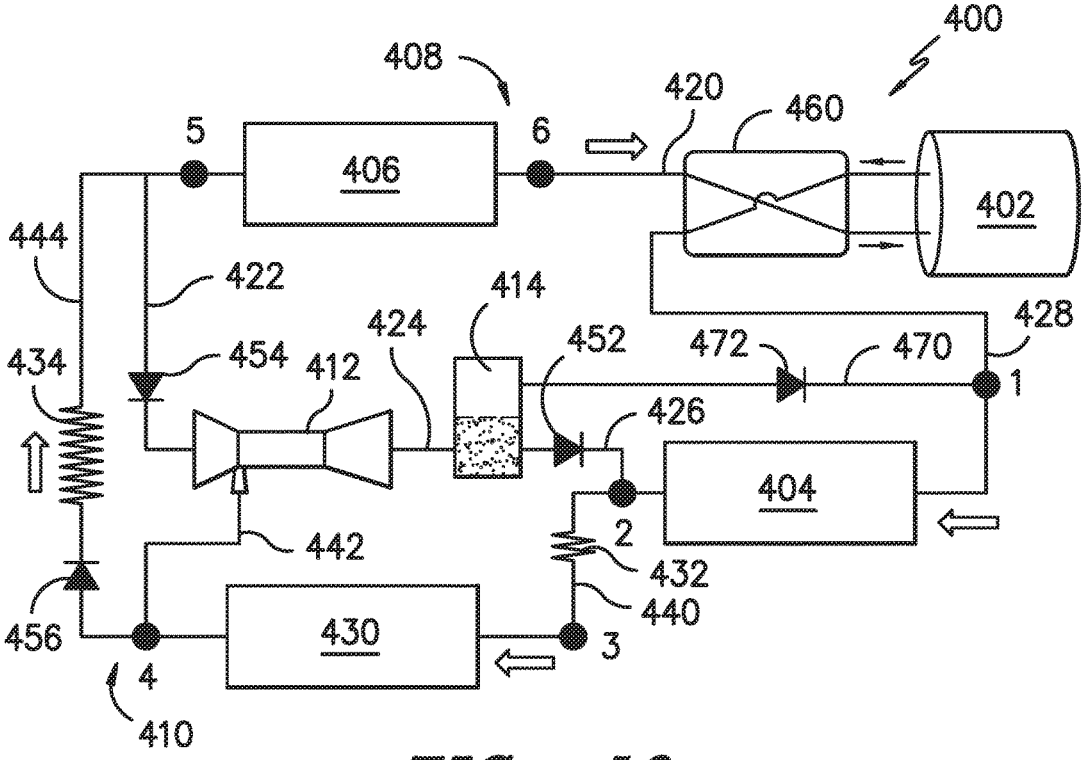
FIGS. 12 and 13 provide a schematic view of components of the exemplary sealed system of FIG. 10 operating in a heating mode and a corresponding pressure-enthalpy (P-h) diagram.
Figure 13:
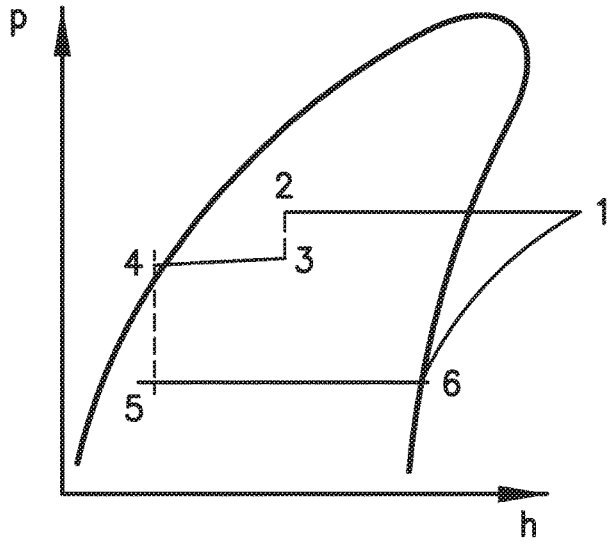

FIGS. 10 through 13 illustrate the sealed system schematic and refrigerant properties, in both a heating mode and a cooling mode, of a sealed system 400 for a packaged terminal air conditioner unit according to alternative exemplary embodiments of the present subject matter. More particularly, FIGS. 10 and 12 provide a schematic view of components of sealed system 400 when sealed system 400 is operating the cooling mode and the heating mode, respectively. FIGS. 11 and 13 provide pressure-enthalpy (P-h) diagrams that illustrate the relationship between the pressure (e.g., in kilopascals) and the enthalpy (e.g., in joules per kilogram) of refrigerant as sealed system 400 operates in the cooling mode and the heating mode, respectively.

Sealed system 400 may be used with or in any suitable packaged terminal air conditioner unit. For example, sealed system 400 may be used in packaged terminal air conditioner unit 100 (FIG. 1) as sealed system 120. The unlabeled arrows in FIGS. 10 and 12 indicate the direction of refrigerant flow within adjacent conduits or piping of sealed system 400 in the cooling mode (FIG. 10) and heating mode (FIG. 12).

Like sealed system 300 (FIG. 6), sealed system 400 generally operates in a heat pump cycle. Sealed system 400 includes similar components to sealed system 300 and operates in a similar manner. For example, sealed system 400 includes a compressor 402, a primary interior heat exchanger or coil 404, an exterior heat exchanger or coil 406, and a primary loop 408 of conduit that operably couples these components. In addition, sealed system 400 includes an auxiliary cooling loop 410 including an ejector 412 and several additional components configured to control the flow and behavior of the refrigerant within sealed system 400, as described below. However, sealed system 400 further includes a phase separator 414, which will be described in detail below.

Primary loop 408 includes a plurality of piping or conduit sections that connect or fluidly couple various components of sealed system 400. More specifically, compressor 402 and exterior coil 406 may be fluidly coupled by a first portion 420 of primary loop 408, exterior coil 406 and ejector 412 may be fluidly coupled by a second portion 422 of primary loop 408, ejector 412 and phase separator 414 may be fluidly coupled by a third portion 424 of primary loop 408, phase separator 414 and primary interior coil 404 may be fluidly coupled by a fourth portion 426 of primary loop 408, and primary interior coil 404 may be fluidly coupled with compressor 402 by a fifth portion 428 of primary loop 408. Moreover, phase separator 414 may further include a vapor bypass conduit 470, which fluidly couples phase separator 414 with fifth portion 428 of primary loop 408, as explained below.

As shown in FIG. 10, auxiliary loop 410 includes ejector 412, a secondary interior coil 430, a first expansion device 432, and a second expansion device 434. Similar to primary loop 408, auxiliary loop 410 includes a plurality of piping or conduit sections that connect or fluidly couple various components of the auxiliary cooling loop 410. For example, a first portion 440 of auxiliary loop 410 splits off fourth portion 426 of primary loop 408 and fluidly couples fourth portion 426 of primary loop 408 and secondary interior coil 430. First expansion device 432 may be coupled to first portion 440 of auxiliary loop 410. A second portion 442 of auxiliary loop 410 fluidly couples secondary interior coil 430 with ejector 412. Second portion 422 of primary loop 408 is fluidly coupled to secondary interior coil 430 by a third portion 444 of auxiliary loop 410. Second expansion device 434 may be coupled to third portion 444 of auxiliary loop 410.

Sealed system 400 may further include one or more one-way valves, e.g., check valves, that are positioned on primary loop 408 or auxiliary loop 410 to prevent the flow of refrigerant in a particular direction. More specifically, as shown in FIGS. 10 and 12, a first check valve 452 may be coupled to fourth portion 426 of primary loop 408, i.e., downstream of phase separator 414 when in the cooling mode but upstream of the junction where auxiliary loop 410 splits off primary loop 408. In this manner, first check valve 452 prevents the flow of refrigerant back into phase separator 414 from primary interior coil 404 and from auxiliary loop 410.

A second check valve 454 may be coupled to second portion 422 of primary loop 408 between exterior coil 406 and ejector 412, i.e., upstream of ejector 412 when in the cooling mode. In this manner, second check valve 454 prevents the flow of refrigerant back into exterior coil 406 from ejector 412.

A third check valve 456 may be coupled to third portion 444 of auxiliary loop 410, i.e., downstream of secondary interior coil 430 when in the cooling mode. In this manner, third check valve 456 prevents the flow of refrigerant back into secondary interior coil 430 from exterior coil 406.

As may be seen in FIGS. 10 and 12, sealed system 400 also includes a reversing valve 460. Reversing valve 460 selectively directs compressed refrigerant from compressor 402 towards either primary interior coil 404 or exterior coil 406. More specifically, in the cooling mode (shown in FIG. 10), reversing valve 460 is arranged or configured to direct compressed refrigerant from compressor 402 to or towards exterior coil 406. Conversely, in the heating mode (shown in FIG. 12), reversing valve 460 is arranged or configured to direct compressed refrigerant from compressor 402 to or towards primary interior coil 404. Thus, reversing valve 460 permits sealed system 400 to adjust between the heating mode and the cooling mode, as will be understood by those skilled in the art.

As shown in FIG. 10, when sealed system 400 is operating in the cooling mode, reversing valve 460 is configured to direct compressed refrigerant from compressor 402 directly to exterior coil 406. Exterior coil 406 acts as a condenser and rejects heat into the exterior atmosphere at exterior side portion 114 of casing 110. For example, the superheated vapor from compressor 402 may pass through exterior coil 406, transfer energy to the exterior atmosphere, and condense into a saturated liquid, a liquid-vapor mixture, and/or a subcooled liquid. An exterior air handler or fan (not shown) may be positioned adjacent exterior coil 406 to facilitate or urge a flow of air from the exterior atmosphere across exterior coil 406 in order to facilitate heat transfer.

The refrigerant then flows through second portion 422 of primary loop 408 and into ejector 412. Notably, third check valve 456 prevents refrigerant from flowing through third portion 444 of auxiliary loop 410 toward secondary interior coil 430. The refrigerant passes through ejector 412, which combines a stream of refrigerant from primary loop 408 with a stream of refrigerant from auxiliary loop 410, thereby improving system efficiency as described above. More specifically, the flow of refrigerant from compressor 402 through ejector 412 entrains vapor phase refrigerant from auxiliary loop 410, i.e., via secondary interior coil 430, and the combined refrigerant stream is passed through phase separator 414. In particular, ejector 412 may be configured for combining streams of refrigerant via the Venturi effect or any other suitable means.

Phase separator 414 is configured for separating liquid refrigerant within phase separator 414 from vapor refrigerant within phase separator 414, e.g., when sealed system 400 is operating in the cooling mode. By separating liquid refrigerant from vapor refrigerant, phase separator 414 may improve a performance and/or efficiency of packaged terminal air conditioner unit 100. For example, the addition of phase separator 414 may further reduce the pressure drop in primary interior coil 404 and/or secondary interior coil 430 by bypassing the vapor flow.

It should be understood that phase separator 414 (as well as other phase separators described herein) may be any suitable type of phase separator. For example, phase separator 414 may be constructed in the same or similar manner to the phase separator described in U.S. Patent Application Publication No. 2015/0143836 and/or the phase separator described in U.S. Patent Application Publication No. 2015/0300710, both of which are incorporated by reference herein for all purposes. Within a casing of phase separator 414, liquid phase refrigerant may collect or pool at a bottom portion of phase separator 414 and vapor phase refrigerant may collect or pool at a top portion of phase separator 414, e.g., due to density differences between the liquid and vapor phase refrigerants.

Fourth portion 426 of primary loop 408 may extend between and fluidly couple the bottom portion of phase separator 414 and the primary interior coil 404. In addition, vapor bypass conduit 470 may extend between and fluidly couple the top portion of phase separator 414 and fifth portion 428 of primary loop 408. In this manner, liquid phase refrigerant in phase separator 414 may pass to primary interior coil 404 as well as secondary interior coil 430 (via first expansion device 432), while vapor phase refrigerant in phase separator 414 may pass through vapor bypass conduit 470 to compressor 402. A vapor bypass check valve 472 may be coupled to vapor bypass conduit 470, i.e., downstream of phase separator 414 when in the cooling mode. In this manner, vapor bypass check valve 472 prevents the flow of refrigerant back into phase separator 414 from compressor 402 or fifth portion 428 of primary loop 408.

Therefore, when sealed system 400 is operating in the cooling mode (FIG. 10), primary interior coil 404 is disposed downstream of phase separator 414 and acts as an evaporator. Similarly, secondary interior coil 430 acts as a secondary evaporator within auxiliary loop 410. Thus, primary interior coil 404 and secondary interior coil 430 are operable to absorb heat from the interior atmosphere at interior side portion 112 of casing 110 when sealed system 400 is operating in the cooling mode. Moreover, primary interior coil 404 and secondary interior coil 430 are both connected downstream of phase separator 414, such that they each receive liquid phase refrigerant from phase separator 414. This refrigerant from phase separator 414 receives energy and vaporizes into superheated vapor and/or high quality vapor mixture before passing back through ejector 412 along auxiliary loop 410 or directly to compressor 402. An interior air handler or fan (not shown) may be positioned adjacent primary interior coil 404 and/or secondary interior coil 430 to facilitate or urge a flow of air from the interior atmosphere across interior coils 404, 430 in order to facilitate heat transfer.

As shown in FIG. 12, when sealed system 400 is operating in the heating mode, reversing valve 460 is configured to direct compressed refrigerant from compressor 402 directly to primary interior coil 404. Vapor bypass check valve 472 and first check valve 452 prevent refrigerant from entering phase separator 414. Therefore, refrigerant passes through primary interior coil 404, directly into auxiliary loop 410, and through secondary interior coil 430. In this manner, primary interior coil 404 and secondary interior coil 430 act as condensers and reject heat to the interior atmosphere at interior side portion 112 of casing 110 when sealed system 400 is operating in the heating mode. One or more interior air handlers or fans (not shown) may be positioned adjacent primary interior coil 404 and/or secondary interior coil 430 to facilitate or urge a flow of air from the interior atmosphere across interior coils 404, 430 in order to facilitate heat transfer.

Upon exiting secondary interior coil 430, refrigerant flows through third portion 444 of auxiliary loop 410 through the forward-biased third check valve 456 and second expansion device 434. Second expansion device 434 may generally expand the refrigerant, thereby lowering its pressure and temperature. The refrigerant may then be flowed through exterior coil 406.

When sealed system 400 is operating in the heating mode, exterior coil 406 acts as an evaporator and absorbs heat energy from the exterior atmosphere, e.g., at exterior side portion 114 of casing 110, when sealed system 400 is operating in the heating mode. For example, within exterior coil 406, the refrigerant from second expansion device 434 receives energy from the exterior atmosphere and vaporizes into superheated vapor and/or high quality vapor mixture. An exterior air handler or fan (not shown) may be positioned adjacent exterior coil 406 to facilitate or urge a flow of air from the exterior atmosphere across exterior coil 406 in order to facilitate heat transfer. From exterior coil 406, refrigerant is directed back to compressor 402, and the cycle is repeated.

Figure 14:
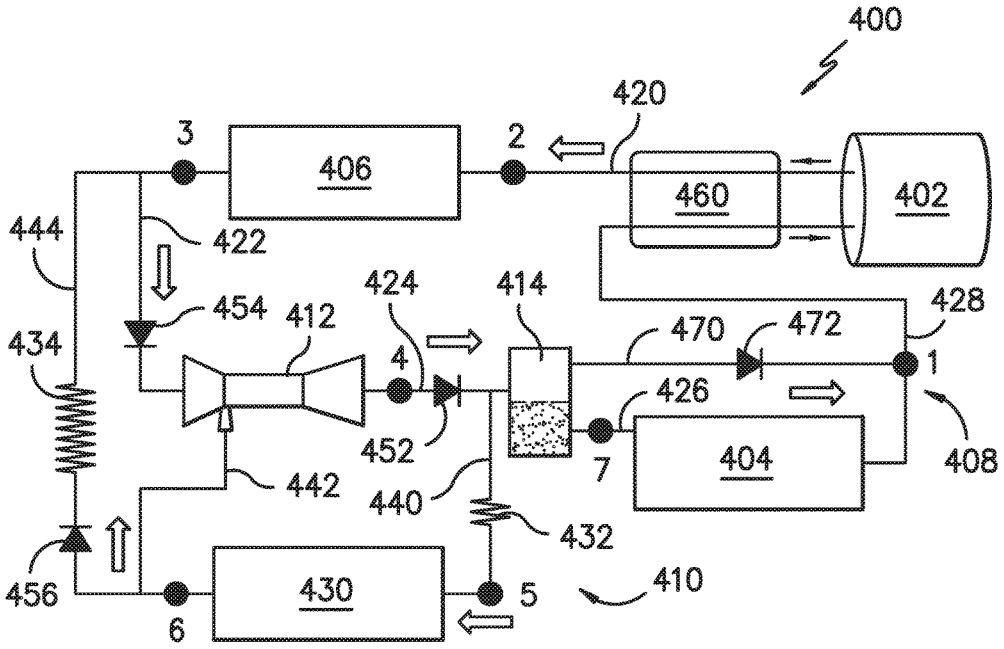
FIGS. 14 and 15 provide a schematic view of components of a sealed system for a packaged terminal air conditioner unit according to an exemplary embodiment of the present subject matter operating in a cooling mode and a corresponding pressure-enthalpy (P-h) diagram.
Figure 15:
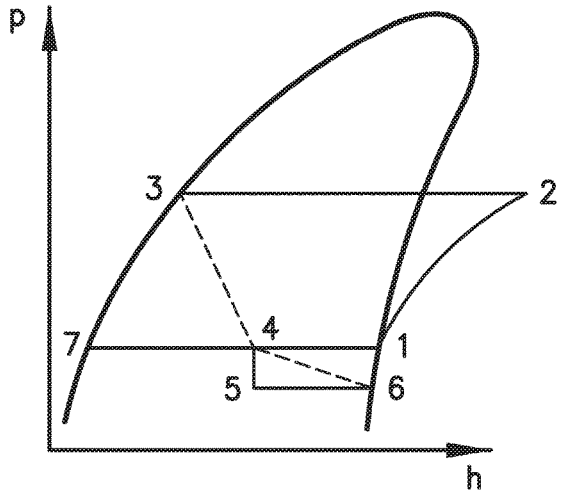
Figure 16:
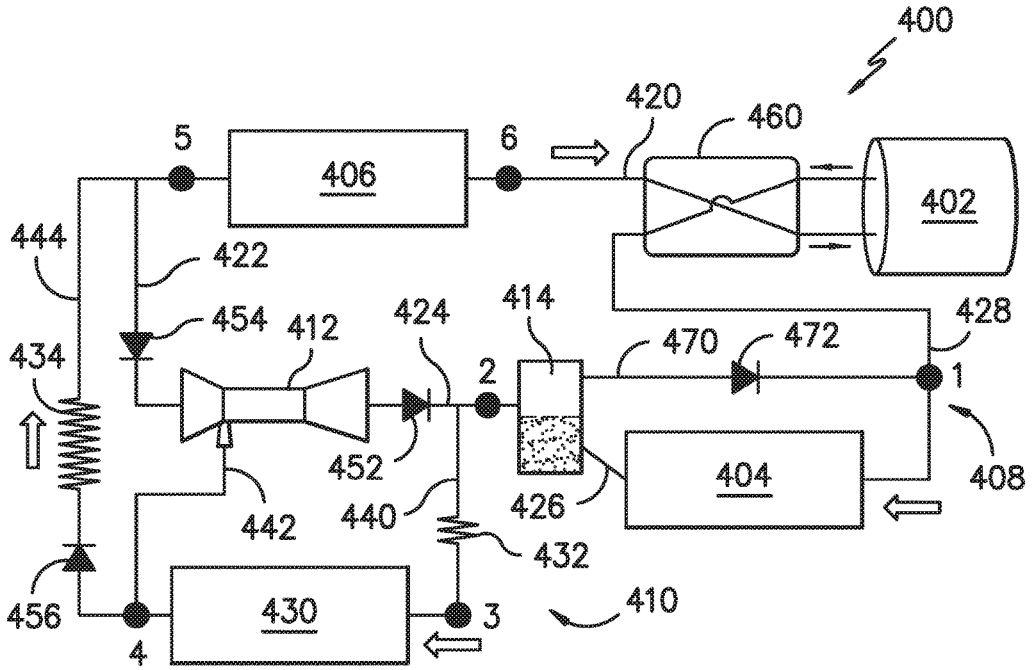
FIGS. 16 and 17 provide a schematic view of components of the exemplary sealed system of FIG. 14 operating in a heating mode and a corresponding pressure-enthalpy (P-h) diagram.
Figure 17:
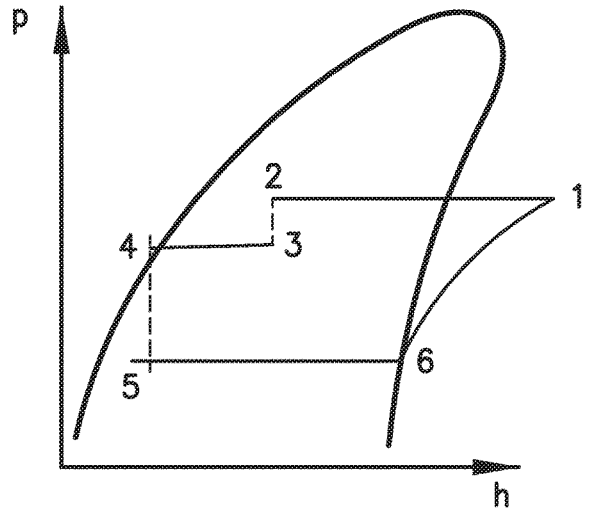

FIGS. 14 through 17 illustrate the sealed system schematic and refrigerant properties, in both a heating mode and a cooling mode, of an alternative embodiment of sealed system 400 for a packaged terminal air conditioner unit according to alternative exemplary embodiments of the present subject matter. More particularly, FIGS. 14 and 16 provide a schematic view of components of sealed system 400 when sealed system 400 is operating the cooling mode and the heating mode, respectively. FIGS. 15 and 17 provide pressure-enthalpy (P-h) diagrams that illustrate the relationship between the pressure (e.g., in kilopascals) and the enthalpy (e.g., in joules per kilogram) of refrigerant as sealed system 400 operates in the cooling mode and the heating mode, respectively.

Sealed system 400 is identical to that described above, except that phase separator 414 is positioned between the point on primary loop 408 where auxiliary loop 410 splits off and primary interior coil 404. In this manner, phase separator 414 feeds liquid phase refrigerant only to primary interior coil 404 (and not secondary interior coil 430) when sealed system 400 operates in the cooling mode. As explained above, by separating liquid refrigerant from vapor refrigerant, phase separator 414 may improve a performance and/or efficiency of packaged terminal air conditioner unit 100, e.g., by reducing the pressure drop in primary interior coil 404 by bypassing the vapor flow.

Figure 18:
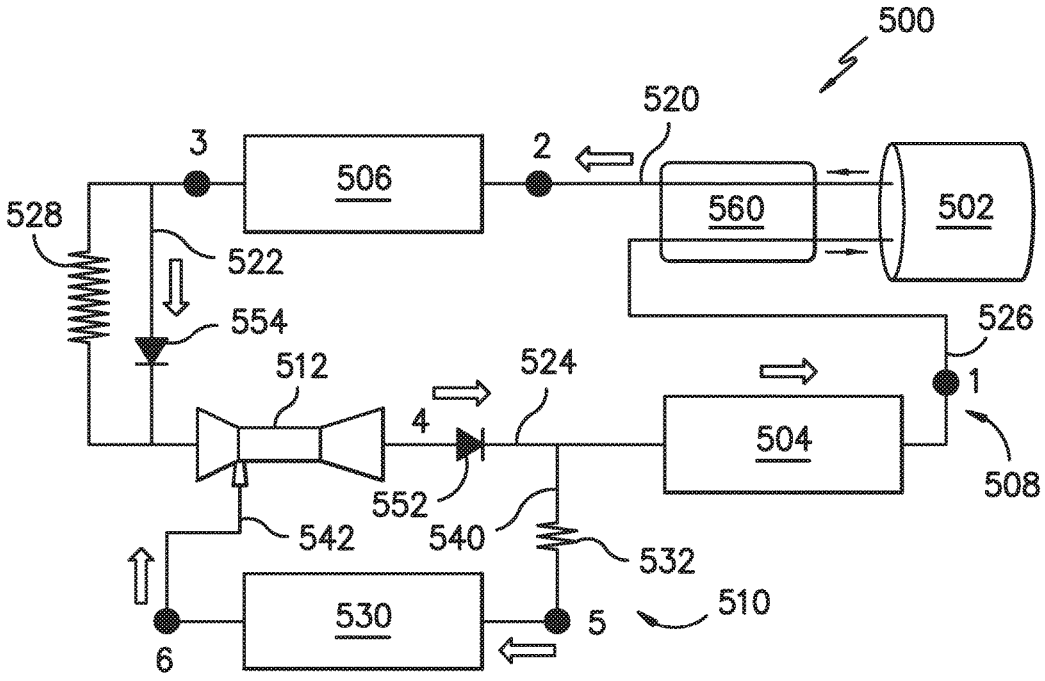
FIGS. 18 and 19 provide a schematic view of components of a sealed system for a packaged terminal air conditioner unit according to an exemplary embodiment of the present subject matter operating in a cooling mode and a corresponding pressure-enthalpy (P-h) diagram.
Figure 19:
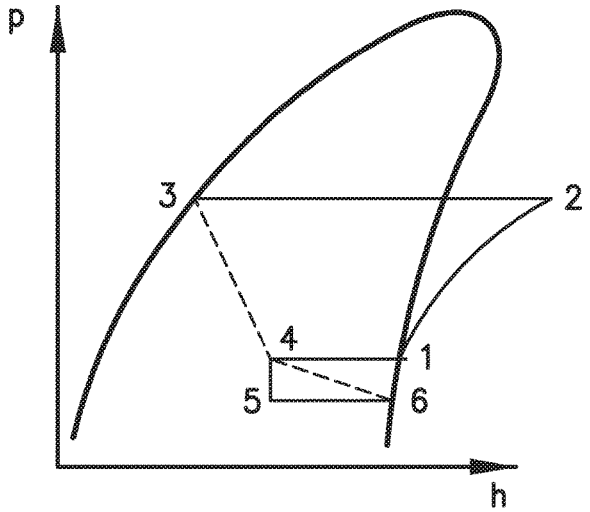
Figure 20:
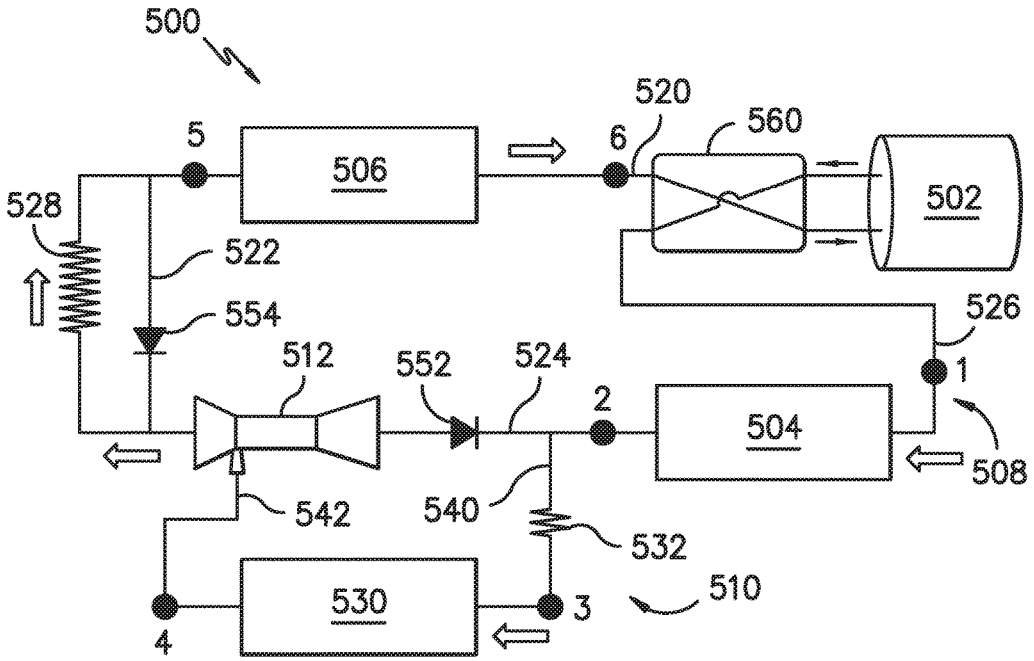
FIGS. 20 and 21 provide a schematic view of components of the exemplary sealed system of FIG. 18 operating in a heating mode and a corresponding pressure-enthalpy (P-h) diagram.
Figure 21:
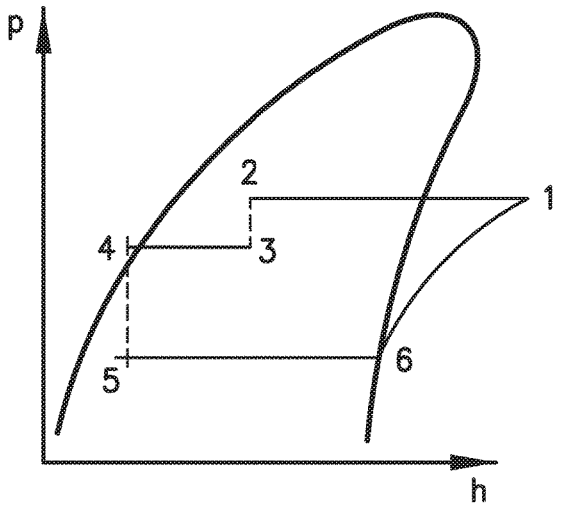

FIGS. 18 through 21 illustrate the sealed system schematic and refrigerant properties, in both a heating mode and a cooling mode, of a sealed system 500 for a packaged terminal air conditioner unit according to another exemplary embodiment of the present subject matter. More particularly, FIGS. 18 and 20 provide a schematic view of components of sealed system 500 when sealed system 500 is operating the cooling mode and the heating mode, respectively. FIGS. 19 and 21 provide pressure-enthalpy (P-h) diagrams that illustrate the relationship between the pressure (e.g., in kilopascals) and the enthalpy (e.g., in joules per kilogram) of refrigerant as sealed system 500 operates in the cooling mode and the heating mode, respectively.

Sealed system 500 may be used with or in any suitable packaged terminal air conditioner unit. For example, sealed system 500 may be used in packaged terminal air conditioner unit 100 (FIG. 1) as sealed system 120. The unlabeled arrows in FIGS. 18 and 20 indicate the direction of refrigerant flow within adjacent conduits or piping of sealed system 500 in the cooling mode and heating mode, respectively.

Like sealed system 300 (FIG. 6), sealed system 500 generally operates in a heat pump cycle. Sealed system 500 includes similar components to sealed system 300 and operates in a similar manner. For example, sealed system 500 includes a compressor 502, a primary interior heat exchanger or coil 504, an exterior heat exchanger or coil 506, and a primary loop 508 of conduit that operably couples these components. Sealed system 500 also includes an auxiliary cooling loop 510 including an ejector 512 and several additional components configured to control the flow and behavior of the refrigerant within sealed system 500, as described below.

Primary loop 508 includes a plurality of piping or conduit sections that connect or fluidly couple various components of sealed system 500. More specifically, compressor 502 and exterior coil 506 may be fluidly coupled by a first portion 520 of primary loop 508, exterior coil 506 and ejector 512 may be fluidly coupled by a second portion 522 of primary loop 508, ejector 512 and primary interior coil 504 may be fluidly coupled by a third portion 524 of primary loop 508, and primary interior coil 504 may be fluidly coupled with compressor 502 by a fourth portion 526 of primary loop 508. A primary loop expansion device 528 may be coupled to second portion 522 of primary loop 508. Primary loop expansion device 528 may generally expand the refrigerant, thereby lowering its pressure and temperature, as explained above.

As shown in FIG. 18, auxiliary loop 510 includes ejector 512, a secondary interior coil 530, and an auxiliary loop expansion device 532. Similar to primary loop 508, auxiliary loop 510 includes a plurality of piping or conduit sections that connect or fluidly couple various components of the auxiliary cooling loop 510. For example, a first portion 540 of auxiliary loop 510 splits off third portion 524 of primary loop 508 and fluidly couples third portion 524 of primary loop 508 and secondary interior coil 530. Auxiliary loop expansion device 532 may be coupled to first portion 540 of auxiliary loop 510. A second portion 542 of auxiliary loop 510 fluidly couples secondary interior coil 530 with ejector 512.

Sealed system 500 may further include one or more one-way valves, e.g., check valves, that are positioned on primary loop 508 to prevent the flow of refrigerant in a particular direction. More specifically, as shown in FIGS. 18 and 20, a first check valve 552 may be coupled to third portion 524 of primary loop 508, i.e., downstream of ejector 512 when in the cooling mode but upstream of the junction where auxiliary loop 510 splits off primary loop 508. In this manner, first check valve 552 prevents the flow of refrigerant back into ejector 512 from primary interior coil 504 and from auxiliary loop 510. Notably second portion 522 of primary loop 508 includes a second check valve 554 that is plumbed in parallel with primary loop expansion device 528. Second check valve 554 is configured to prevent the flow of refrigerant back in to exterior coil 506 through second check valve 554 when in the heating mode, thereby forcing the refrigerant through primary loop expansion device 528. In this manner, refrigerant flows through forward-biased second check valve 554 when sealed system 500 is operating in the cooling mode (FIG. 18) and flows through primary loop expansion device 528 when sealed system 500 is operating in the heating mode (FIG. 20).

As may be seen in FIGS. 18 and 20, sealed system 500 also includes a reversing valve 560. Reversing valve 560 selectively directs compressed refrigerant from compressor 502 towards either primary interior coil 504 or exterior coil 506. More specifically, in the cooling mode (shown in FIG. 18), reversing valve 560 is arranged or configured to direct compressed refrigerant from compressor 502 to or towards exterior coil 506. Conversely, in the heating mode (shown in FIG. 20), reversing valve 560 is arranged or configured to direct compressed refrigerant from compressor 502 to or towards primary interior coil 504. Thus, reversing valve 560 permits sealed system 500 to adjust between the heating mode and the cooling mode, as will be understood by those skilled in the art.

As shown in FIG. 18, when sealed system 500 is operating in the cooling mode, reversing valve 560 is configured to direct compressed refrigerant from compressor 502 directly to exterior coil 506. Exterior coil 506 acts as a condenser and rejects heat into the exterior atmosphere at exterior side portion 114 of casing 110. For example, the superheated vapor from compressor 502 may pass through exterior coil 506, transfer energy to the exterior atmosphere, and condense into a saturated liquid, a liquid-vapor mixture, and/or a subcooled liquid. An exterior air handler or fan (not shown) may be positioned adjacent exterior coil 506 to facilitate or urge a flow of air from the exterior atmosphere across exterior coil 506 in order to facilitate heat transfer.

The refrigerant then flows through second portion 522 of primary loop 508 through second check valve 554 and into ejector 512. The refrigerant passes through ejector 512, which combines a stream of refrigerant from primary loop 508 with a stream of refrigerant from auxiliary loop 510, thereby improving system efficiency as described above. More specifically, the flow of refrigerant from compressor 502 through ejector 512 entrains vapor phase refrigerant from auxiliary loop 510, i.e., via secondary interior coil 530. From ejector 512, the combined refrigerant stream is passed through both primary interior coil 504 (via third portion 524 of primary loop 508) and through secondary interior coil 530 (via first expansion device 532). In particular, ejector 512 may be configured for combining streams of refrigerant via the Venturi effect or any other suitable means.

Therefore, when sealed system 500 is operating in the cooling mode (FIG. 18), primary interior coil 504 is disposed downstream of ejector 512 and acts as an evaporator. Similarly, secondary interior coil 530 acts as a secondary evaporator within auxiliary loop 510. Thus, primary interior coil 504 and secondary interior coil 530 are operable to absorb heat from the interior atmosphere at interior side portion 112 of casing 110 when sealed system 500 is operating in the cooling mode. The refrigerant from ejector 512 receives energy and vaporizes into superheated vapor and/or high quality vapor mixture before passing to compressor 502. An interior air handler or fan (not shown) may be positioned adjacent primary interior coil 504 and/or secondary interior coil 530 to facilitate or urge a flow of air from the interior atmosphere across interior coils 504, 530 in order to facilitate heat transfer.

As shown in FIG. 20, when sealed system 500 is operating in the heating mode, reversing valve 560 is configured to direct compressed refrigerant from compressor 502 directly to primary interior coil 504. First check valve 552 and second check valve 554 are operable to prevent refrigerant from flowing through ejector 512 and through second portion 522 of primary loop 508. Therefore, refrigerant passes through primary interior coil 504, directly into auxiliary loop 510, and through secondary interior coil 530. In this manner, primary interior coil 504 and secondary interior coil 530 act as condensers and reject heat to the interior atmosphere at interior side portion 112 of casing 110 when sealed system 500 is operating in the heating mode. One or more interior air handlers or fans (not shown) may be positioned adjacent primary interior coil 504 and/or secondary interior coil 530 to facilitate or urge a flow of air from the interior atmosphere across interior coils 504, 530 in order to facilitate heat transfer.

Upon exiting secondary interior coil 530, refrigerant flows through second portion 542 of auxiliary loop 510 and through ejector 512. Second check valve 554 forces the flow of refrigerant through primary loop expansion device 528, which may generally expand the refrigerant, thereby lowering its pressure and temperature. The refrigerant may then be flowed through exterior coil 506.

When sealed system 500 is operating in the heating mode, exterior coil 506 acts as an evaporator and absorbs heat energy from the exterior atmosphere, e.g., at exterior side portion 114 of casing 110, when sealed system 500 is operating in the heating mode. For example, within exterior coil 506, the refrigerant from primary loop expansion device 528 receives energy from the exterior atmosphere and vaporizes into superheated vapor and/or high quality vapor mixture. An exterior air handler or fan (not shown) may be positioned adjacent exterior coil 506 to facilitate or urge a flow of air from the exterior atmosphere across exterior coil 506 in order to facilitate heat transfer. From exterior coil 506, refrigerant is directed back to compressor 502, and the cycle is repeated.

Figure 22:
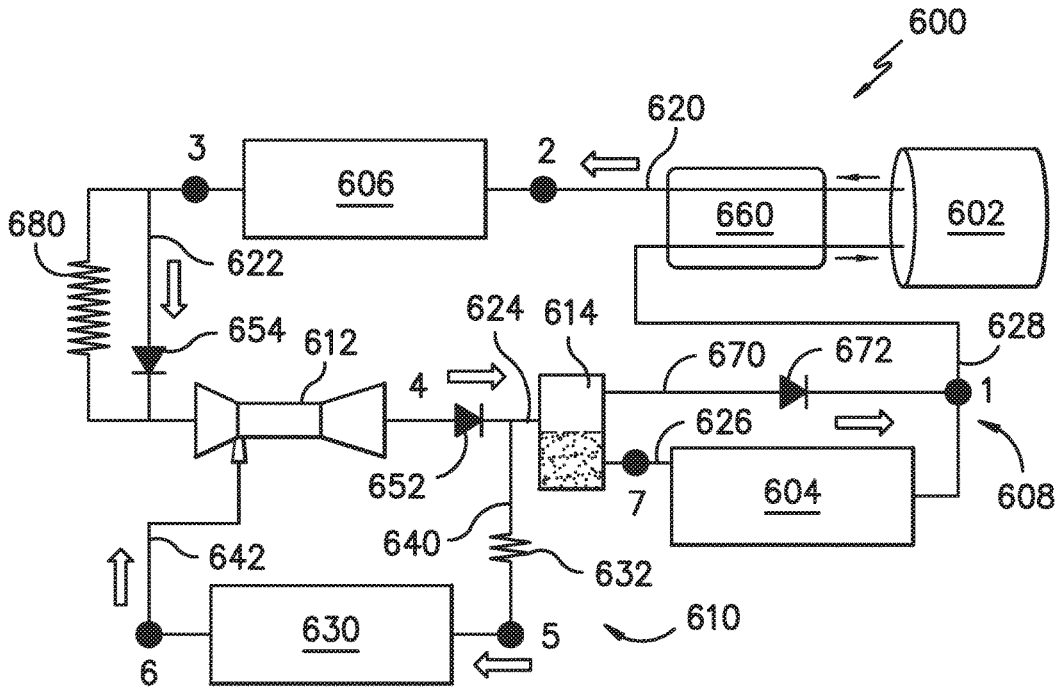
FIGS. 22 and 23 provide a schematic view of components of a sealed system for a packaged terminal air conditioner unit according to an exemplary embodiment of the present subject matter operating in a cooling mode and a corresponding pressure-enthalpy (P-h) diagram.
Figure 23:
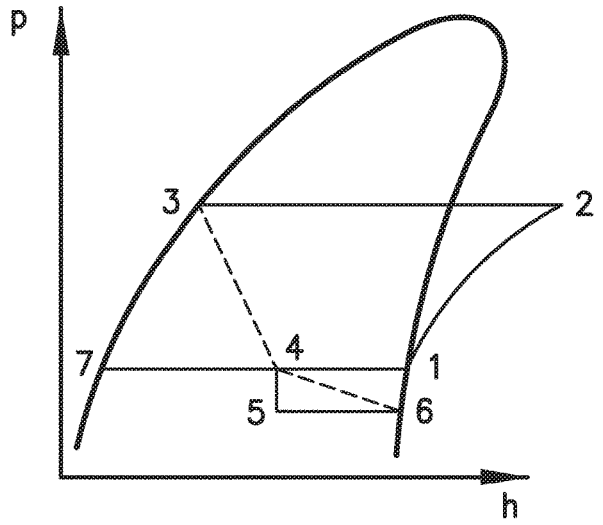
Figure 24:
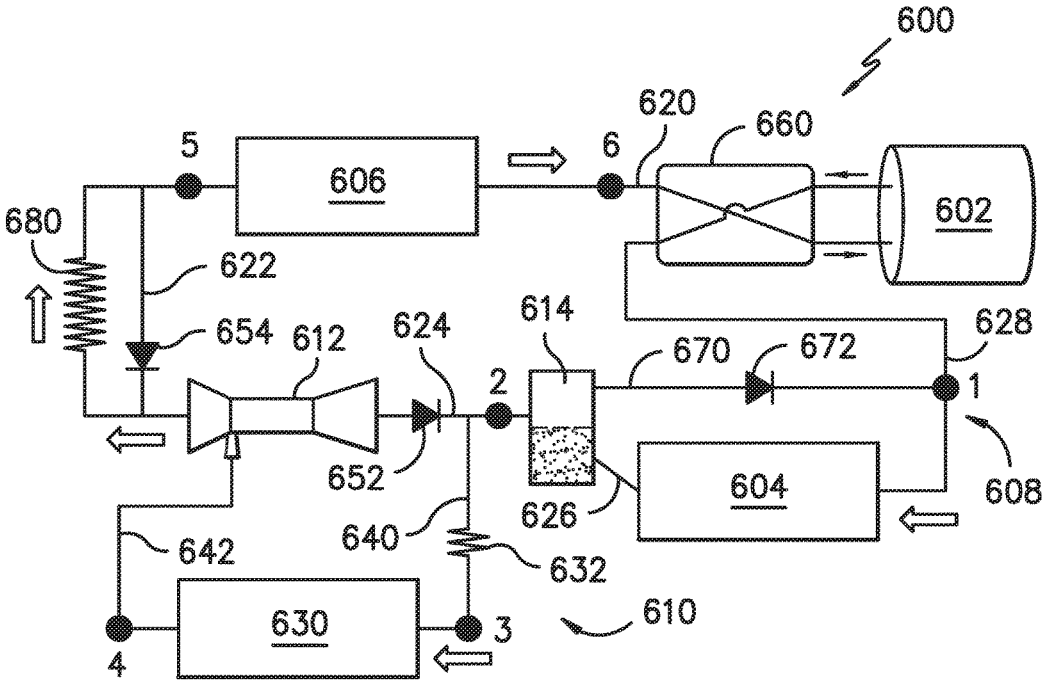
FIGS. 24 and 25 provide a schematic view of components of the exemplary sealed system of FIG. 22 operating in a heating mode and a corresponding pressure-enthalpy (P-h) diagram.
Figure 25:
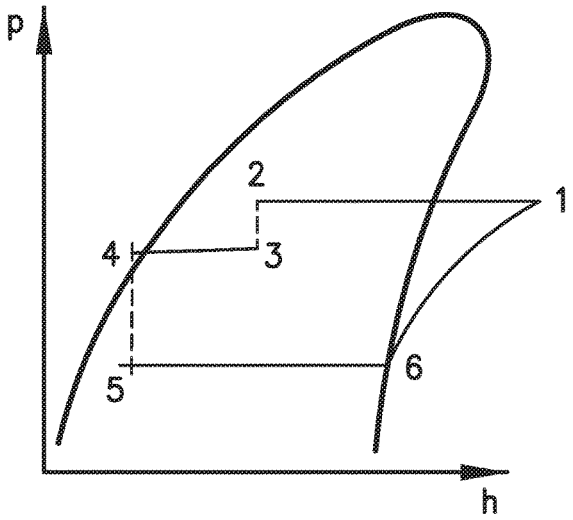

FIGS. 22 through 25 illustrate the sealed system schematic and refrigerant properties, in both a heating mode and a cooling mode, of a sealed system 600 for a packaged terminal air conditioner unit according to alternative exemplary embodiments of the present subject matter. More particularly, FIGS. 22 and 24 provide a schematic view of components of sealed system 600 when sealed system 600 is operating the cooling mode and the heating mode, respectively. FIGS. 23 and 25 provide pressure-enthalpy (P-h) diagrams that illustrate the relationship between the pressure (e.g., in kilopascals) and the enthalpy (e.g., in joules per kilogram) of refrigerant as sealed system 600 operates in the cooling mode and the heating mode, respectively.

Sealed system 600 may be used with or in any suitable packaged terminal air conditioner unit. For example, sealed system 600 may be used in packaged terminal air conditioner unit 100 (FIG. 1) as sealed system 120. The unlabeled arrows in FIGS. 22 and 24 indicate the direction of refrigerant flow within adjacent conduits or piping of sealed system 600 in the cooling mode (FIG. 22) and the heating mode (FIG. 24).

Like sealed system 300 (FIG. 6), sealed system 600 generally operates in a heat pump cycle. Sealed system 600 includes similar components to sealed system 300 and operates in a similar manner. For example, sealed system 600 includes a compressor 602, a primary interior heat exchanger or coil 604, an exterior heat exchanger or coil 606, and a primary loop 608 of conduit that operably couples these components. In addition, sealed system 600 includes an auxiliary cooling loop 610 including an ejector 612 and several additional components configured to control the flow and behavior of the refrigerant within sealed system 600, as described below. However, sealed system 600 further includes a phase separator 614, which will be described in detail below.

Primary loop 608 includes a plurality of piping or conduit sections that connect or fluidly couple various components of sealed system 600. More specifically, compressor 602 and exterior coil 606 may be fluidly coupled by a first portion 620 of primary loop 608, exterior coil 606 and ejector 612 may be fluidly coupled by a second portion 622 of primary loop 608, ejector 612 and phase separator 614 may be fluidly coupled by a third portion 624 of primary loop 608, phase separator 614 and primary interior coil 604 may be fluidly coupled by a fourth portion 626 of primary loop 608, and primary interior coil 604 may be fluidly coupled with compressor 602 by a fifth portion 628 of primary loop 608. Moreover, phase separator 614 may further include a vapor bypass conduit 670, which fluidly couples phase separator 614 with fifth portion 628 of primary loop 608, as explained below.

As shown in FIG. 22, auxiliary loop 610 includes ejector 612, a secondary interior coil 630, and a first expansion device 632. Similar to primary loop 608, auxiliary loop 610 includes a plurality of piping or conduit sections that connect or fluidly couple various components of the auxiliary cooling loop 610. For example, a first portion 640 of auxiliary loop 610 splits off third portion 624 of primary loop 608 and fluidly couples third portion 624 of primary loop 608 and secondary interior coil 630. First expansion device 632 may be coupled to first portion 640 of auxiliary loop 610. A second portion 642 of auxiliary loop 610 fluidly couples secondary interior coil 630 with ejector 612.

Sealed system 600 may further include one or more one-way valves, e.g., check valves, that are positioned on primary loop 608 to prevent the flow of refrigerant in a particular direction. More specifically, as shown in FIGS. 22 and 24, a first check valve 652 may be coupled to third portion 624 of primary loop 608, i.e., downstream of ejector 612 when in the cooling mode but upstream of the junction where auxiliary loop 610 splits off primary loop 608. In this manner, first check valve 652 prevents the flow of refrigerant back into ejector 612 from primary interior coil 604 and from auxiliary loop 610.

A second check valve 654 may be coupled to second portion 622 of primary loop 608 between exterior coil 606 and ejector 612, i.e., upstream of ejector 612 when in the cooling mode. In this manner, second check valve 654 is plumbed in parallel with a second expansion device 680 and is configured to prevent the flow of refrigerant back into exterior coil 606 from ejector 612, thereby forcing the flow of refrigerant from ejector 612 into exterior coil 606 through second expansion device 680 when the sealed system 600 is operating in the heating mode.

As may be seen in FIGS. 22 and 24, sealed system 600 also includes a reversing valve 660. Reversing valve 660 selectively directs compressed refrigerant from compressor 602 towards either primary interior coil 604 or exterior coil 606. More specifically, in the cooling mode (shown in FIG. 22), reversing valve 660 is arranged or configured to direct compressed refrigerant from compressor 602 to or towards exterior coil 606. Conversely, in the heating mode (shown in FIG. 24), reversing valve 660 is arranged or configured to direct compressed refrigerant from compressor 602 to or towards primary interior coil 604. Thus, reversing valve 660 permits sealed system 600 to adjust between the heating mode and the cooling mode, as will be understood by those skilled in the art.

As shown in FIG. 22, when sealed system 600 is operating in the cooling mode, reversing valve 660 is configured to direct compressed refrigerant from compressor 602 directly to exterior coil 606. Exterior coil 606 acts as a condenser and rejects heat into the exterior atmosphere at exterior side portion 114 of casing 110. For example, the superheated vapor from compressor 602 may pass through exterior coil 606, transfer energy to the exterior atmosphere, and condense into a saturated liquid, a liquid-vapor mixture, and/or a subcooled liquid. An exterior air handler or fan (not shown) may be positioned adjacent exterior coil 606 to facilitate or urge a flow of air from the exterior atmosphere across exterior coil 606 in order to facilitate heat transfer.

The refrigerant then flows through second portion 622 of primary loop 608, through forward-biased second check valve 654, and into ejector 612. The refrigerant passes through ejector 612, which combines a stream of refrigerant from primary loop 608 with a stream of refrigerant from auxiliary loop 610, thereby improving system efficiency as described above. More specifically, the flow of refrigerant from compressor 602 through ejector 612 entrains vapor phase refrigerant from auxiliary loop 610, i.e., via secondary interior coil 630. From ejector 612, the combined refrigerant stream is passed through both phase separator 614 (via third portion 624 of primary loop 608) and through secondary interior coil 630 (via first expansion device 632). In particular, ejector 612 may be configured for combining streams of refrigerant via the Venturi effect or any other suitable means.

Phase separator 614 is configured for separating liquid refrigerant within phase separator 614 from vapor refrigerant within phase separator 614, e.g., when sealed system 600 is operating in the cooling mode. More specifically, within a casing of phase separator 614, liquid phase refrigerant may collect or pool at a bottom portion of phase separator 614 and vapor phase refrigerant may collect or pool at a top portion of phase separator 614, e.g., due to density differences between the liquid and vapor phase refrigerants. By separating liquid refrigerant from vapor refrigerant, phase separator 614 may improve a performance and/or efficiency of packaged terminal air conditioner unit 100, as discussed in greater detail below.

Fourth portion 626 of primary loop 608 may extend between and fluidly couple the bottom portion of phase separator 614 and the primary interior coil 604. In addition, vapor bypass conduit 670 may extend between and fluidly couple the top portion of phase separator 614 and fifth portion 628 of primary loop 608. In this manner, liquid phase refrigerant in phase separator 614 may pass to primary interior coil 604 while vapor phase refrigerant in phase separator 614 may pass through vapor bypass conduit 670 to compressor 602. A vapor bypass check valve 672 may be coupled to vapor bypass conduit 670, i.e., downstream of phase separator 614 when in the cooling mode. In this manner, vapor bypass check valve 672 prevents the flow of refrigerant back into phase separator 614 from compressor 602 or fifth portion 628 of primary loop 608.

Therefore, when sealed system 600 is operating in the cooling mode (FIG. 22), primary interior coil 604 is disposed downstream of phase separator 614 and acts as an evaporator. Similarly, secondary interior coil 630 acts as a secondary evaporator within auxiliary loop 610. Thus, primary interior coil 604 and secondary interior coil 630 are operable to absorb heat from the interior atmosphere at interior side portion 112 of casing 110 when sealed system 600 is operating in the cooling mode. This refrigerant from phase separator 614 receives energy and vaporizes into superheated vapor and/or high quality vapor mixture as it passes through primary interior coil 604 before passing back to compressor 602. An interior air handler or fan (not shown) may be positioned adjacent primary interior coil 604 and/or secondary interior coil 630 to facilitate or urge a flow of air from the interior atmosphere across interior coils 604, 630 in order to facilitate heat transfer.

As shown in FIG. 24, when sealed system 600 is operating in the heating mode, reversing valve 660 is configured to direct compressed refrigerant from compressor 602 directly to primary interior coil 604. Vapor bypass check valve 672 and first check valve 652 prevent refrigerant from entering phase separator 614 and ejector 612, respectively. Therefore, refrigerant passes through primary interior coil 604, directly into auxiliary loop 610, and through secondary interior coil 630. In this manner, primary interior coil 604 and secondary interior coil 630 act as condensers and reject heat to the interior atmosphere at interior side portion 112 of casing 110 when sealed system 600 is operating in the heating mode. One or more interior air handlers or fans (not shown) may be positioned adjacent primary interior coil 604 and/or secondary interior coil 630 to facilitate or urge a flow of air from the interior atmosphere across interior coils 604, 630 in order to facilitate heat transfer.

Upon exiting secondary interior coil 630, refrigerant flows through second portion 642 of auxiliary loop 610 and through ejector 612. Second check valve 654 is plumbed in parallel with second expansion device 680 and is configured to prevent the flow of refrigerant back in to exterior coil 606 through second check valve 654 when in the heating mode, thereby forcing the refrigerant through second expansion device 680. In this manner, refrigerant flows through forward-biased second check valve 654 when sealed system 600 is operating in the cooling mode (FIG. 22) and flows through second expansion device 680 when sealed system 600 is operating in the heating mode (FIG. 24).

When sealed system 600 is operating in the heating mode, exterior coil 606 acts as an evaporator and absorbs heat energy from the exterior atmosphere, e.g., at exterior side portion 114 of casing 110, when sealed system 600 is operating in the heating mode. For example, within exterior coil 606, the refrigerant from second expansion device 680 receives energy from the exterior atmosphere and vaporizes into superheated vapor and/or high quality vapor mixture. An exterior air handler or fan (not shown) may be positioned adjacent exterior coil 606 to facilitate or urge a flow of air from the exterior atmosphere across exterior coil 606 in order to facilitate heat transfer. From exterior coil 606, refrigerant is directed back to compressor 602, and the cycle is repeated.

Figure 26:
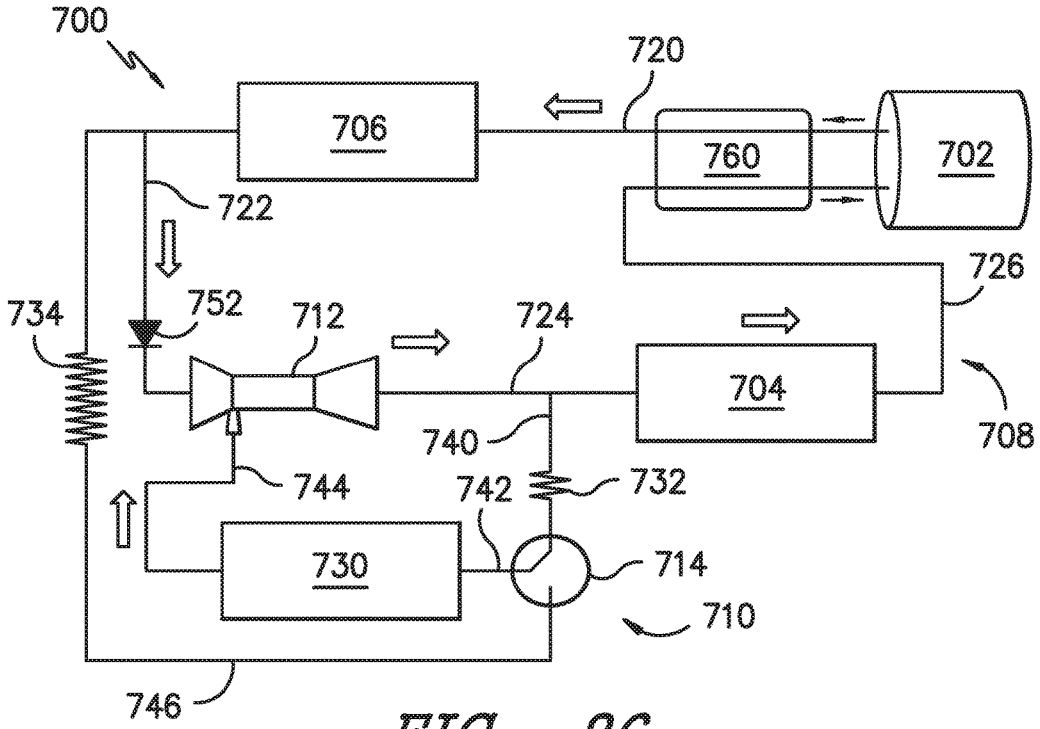
FIGS. 26 and 27 provide a schematic view of components of a sealed system for a packaged terminal air conditioner unit according to an exemplary embodiment of the present subject matter operating in a cooling mode and a heating mode, respectively.
Figure 27:
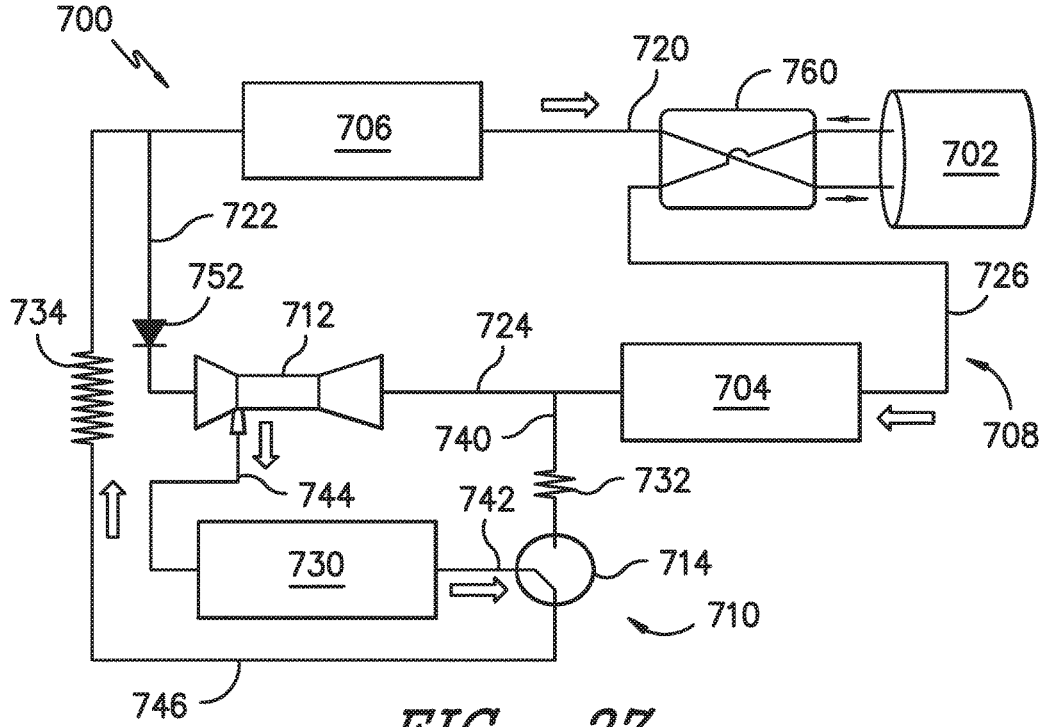

FIGS. 26 and 27 illustrate a sealed system 700 for a packaged terminal air conditioner unit according to alternative exemplary embodiments of the present subject matter, operating in a cooling mode and a heating mode, respectively. Sealed system 700 may be used with or in any suitable packaged terminal air conditioner unit. For example, sealed system 700 may be used in packaged terminal air conditioner unit 100 (FIG. 1) as sealed system 120. The unlabeled arrows in FIGS. 26 and 27 indicate the direction of refrigerant flow within adjacent conduits or piping of sealed system 700 in the cooling mode and heating mode, respectively.

Like sealed system 300 (FIG. 6), sealed system 700 generally operates in a heat pump cycle. Sealed system 700 includes similar components to sealed system 200 and operates in a similar manner. For example, sealed system 700 includes a compressor 702, a primary interior heat exchanger or coil 704, an exterior heat exchanger or coil 706, and a primary loop 708 of conduit that operably couples these components. In addition, sealed system 700 also includes an auxiliary cooling loop 710 including an ejector 712 and a three-way valve 714 to control the flow and behavior of the refrigerant within sealed system 700, as described below.

Primary loop 708 includes a plurality of piping or conduit sections that connect or fluidly couple various components of sealed system 700. More specifically, compressor 702 and exterior coil 706 may be fluidly coupled by a first portion 720 of primary loop 708, exterior coil 706 and ejector 712 may be fluidly coupled by a second portion 722 of primary loop 708, ejector 712 and primary interior coil 704 may be fluidly coupled by a third portion 724 of primary loop 708, and primary interior coil 704 may be fluidly coupled with compressor 702 by a fourth portion 726 of primary loop 708.

As shown in FIG. 26, auxiliary loop 710 includes ejector 712, a secondary interior coil 730, a first expansion device 732, three-way valve 714, and a second expansion device 734. Similar to primary loop 708, auxiliary loop 710 includes a plurality of piping or conduit sections that connect or fluidly couple various components of the auxiliary cooling loop 710. For example, a first portion 740 of auxiliary loop 710 splits off third portion 724 of primary loop 708 and fluidly couples third portion 724 of primary loop 708 and three-way valve 714. A second portion 742 of auxiliary loop 710 extends between and fluidly couples three-way valve 714 and secondary interior coil 730. Secondary interior coil 730 is fluidly coupled to ejector 712 by a third portion 744 of auxiliary loop 710. Three-way valve 714 is also coupled to second portion 722 of primary loop 708 by a fourth portion 746 of auxiliary loop 710.

Three-way valve 714 assists with switching sealed system 700 between the cooling mode and the heating mode, e.g., by modifying the flow of refrigerant between components of sealed system 700. For example, three-way valve 714 may be configured for selectively adjusting the flow of refrigerant between a first portion 740, a second portion 742, and a fourth portion 746 of auxiliary loop 710. More specifically, three-way valve 714 may be configured to switch between a first state (i.e., the cooling mode) that fluidly couples first portion 740 to second portion 742 and a second state (i.e., the heating mode) that fluidly couples second portion 742 and fourth portion 746 of auxiliary loop 710. First expansion device 732 may be coupled to first portion 740 of auxiliary loop 710 and second expansion device 734 may be coupled to fourth portion 746 of auxiliary loop 710.

Sealed system 700 may further include one or more one-way valves, e.g., check valves, that are positioned on primary loop 708 or auxiliary loop 710 to prevent the flow of refrigerant in a particular direction. More specifically, as shown in FIGS. 26 and 27, a first check valve 752 may be coupled to second portion 722 of primary loop 708 between exterior coil 706 and ejector 712, i.e., upstream of ejector 712 when in the cooling mode. In this manner, first check valve 752 prevents the flow of refrigerant back into exterior coil 706 from ejector 712.

As may be seen in FIGS. 26 and 27, sealed system 700 also includes a reversing valve 760. Reversing valve 760 selectively directs compressed refrigerant from compressor 702 towards either primary interior coil 704 or exterior coil 706. More specifically, in the cooling mode (shown in FIG. 26), reversing valve 760 is arranged or configured to direct compressed refrigerant from compressor 702 to or towards exterior coil 706. Conversely, in the heating mode (shown in FIG. 27), reversing valve 760 is arranged or configured to direct compressed refrigerant from compressor 702 to or towards primary interior coil 704. Thus, reversing valve 760 permits sealed system 700 to adjust between the heating mode and the cooling mode, as will be understood by those skilled in the art.

As shown in FIG. 26, when sealed system 700 is operating in the cooling mode, reversing valve 760 is configured to direct compressed refrigerant from compressor 702 directly to exterior coil 706. Exterior coil 706 acts as a condenser and rejects heat into the exterior atmosphere at exterior side portion 114 of casing 110. For example, the superheated vapor from compressor 702 may pass through exterior coil 706, transfer energy to the exterior atmosphere, and condense into a saturated liquid, a liquid-vapor mixture, and/or a subcooled liquid. An exterior air handler or fan (not shown) may be positioned adjacent exterior coil 706 to facilitate or urge a flow of air from the exterior atmosphere across exterior coil 706 in order to facilitate heat transfer.

The refrigerant then flows through second portion 722 of primary loop 708. Notably, three-way valve 714 is in its first state (i.e., cooling mode) such that fourth portion 746 is disconnected from second portion 742 of auxiliary loop 710. Therefore, refrigerant will not flow through fourth portion 746, but is instead forced through second portion 722 of primary loop 708 into ejector 712. The refrigerant passes through ejector 712, which combines a stream of refrigerant from primary loop 708 with a stream of refrigerant from auxiliary loop 710, thereby improving system efficiency as described above. More specifically, the flow of refrigerant from compressor 702 through ejector 712 entrains vapor phase refrigerant from auxiliary loop 710, i.e., via secondary interior coil 730. From ejector 712, the combined refrigerant stream is passed through both primary interior coil 704 (via third portion 724 of primary loop 708) and through secondary interior coil 730 (via first expansion device 732). In particular, ejector 712 may be configured for combining streams of refrigerant via the Venturi effect or any other suitable means.

Therefore, when sealed system 700 is operating in the cooling mode (FIG. 26), primary interior coil 704 is disposed downstream of ejector 712 and acts as an evaporator. Notably, three-way valve 714 is in the first state when sealed system 700 is operating in the cooling mode, thereby coupling first portion 740 to second portion 742 and enabling the flow of refrigerant through auxiliary loop 710 and secondary interior coil 730. Therefore, secondary interior coil 730 acts as a secondary evaporator within auxiliary loop 710. Thus, primary interior coil 704 and secondary interior coil 730 are operable to absorb heat from the interior atmosphere at interior side portion 112 of casing 110 when sealed system 700 is operating in the cooling mode. The refrigerant from ejector 712 receives energy and vaporizes into superheated vapor and/or high quality vapor mixture before passing to compressor 702. An interior air handler or fan (not shown) may be positioned adjacent primary interior coil 704 and/or secondary interior coil 730 to facilitate or urge a flow of air from the interior atmosphere across interior coils 704, 730 in order to facilitate heat transfer.

As shown in FIG. 27 when sealed system 700 is operating in the heating mode, reversing valve 760 is configured to direct compressed refrigerant from compressor 702 directly to primary interior coil 704. Three-way valve 714 is in the second state (i.e., the heating mode) when sealed system 700 is operating in the heating mode, thereby preventing the flow of refrigerant through first portion 740 of auxiliary loop 710 and coupling second portion 742 to third portion 744 of auxiliary loop. In addition, first check valve 752 is operable to prevent refrigerant from flowing from ejector 712 through second portion 722 of primary loop 708 toward compressor 702. Therefore, refrigerant passes through primary interior coil 704, through ejector 712 in the reverse direction, and through secondary interior coil 730. In this manner, primary interior coil 704 and secondary interior coil 730 act as condensers and reject heat to the interior atmosphere at interior side portion 112 of casing 110 when sealed system 700 is operating in the heating mode. One or more interior air handlers or fans (not shown) may be positioned adjacent primary interior coil 704 and/or secondary interior coil 730 to facilitate or urge a flow of air from the interior atmosphere across interior coils 704, 730 in order to facilitate heat transfer.

Upon exiting secondary interior coil 730, refrigerant flows through second portion 742 of auxiliary loop 710, through three-way valve 714, and into fourth portion 746 of auxiliary loop 710. Second expansion device 734 is coupled to fourth portion 746 of auxiliary loop 710 and may generally expand the refrigerant prior to entering exterior coil 706, thereby lowering its pressure and temperature.

After exiting second expansion device 734, refrigerant enters exterior coil 706. When sealed system 700 is operating in the heating mode, exterior coil 706 acts as an evaporator and absorbs heat energy from the exterior atmosphere, e.g., at exterior side portion 114 of casing 110, when sealed system 700 is operating in the heating mode. For example, within exterior coil 706, the refrigerant from second expansion device 734 receives energy from the exterior atmosphere and vaporizes into superheated vapor and/or high quality vapor mixture. An exterior air handler or fan (not shown) may be positioned adjacent exterior coil 706 to facilitate or urge a flow of air from the exterior atmosphere across exterior coil 706 in order to facilitate heat transfer. From exterior coil 706, refrigerant is directed back to compressor 702, and the cycle is repeated.

Figure 28:
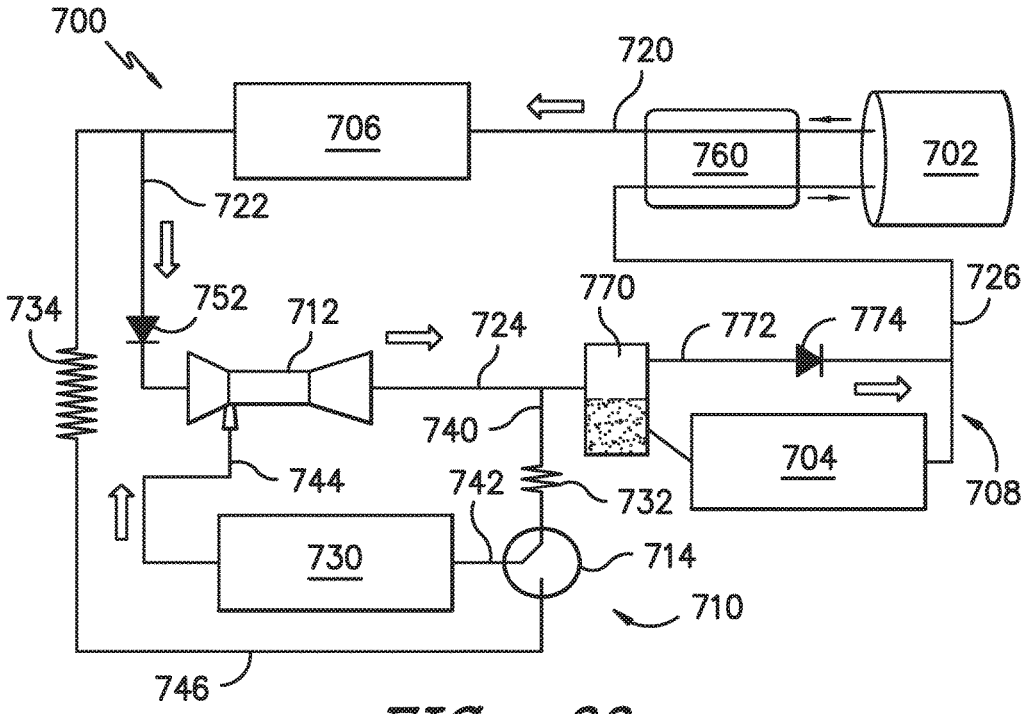
FIGS. 28 and 29 provide a schematic view of components of a sealed system for a packaged terminal air conditioner unit according to an exemplary embodiment of the present subject matter operating in a cooling mode and a heating mode, respectively.
Figure 29:
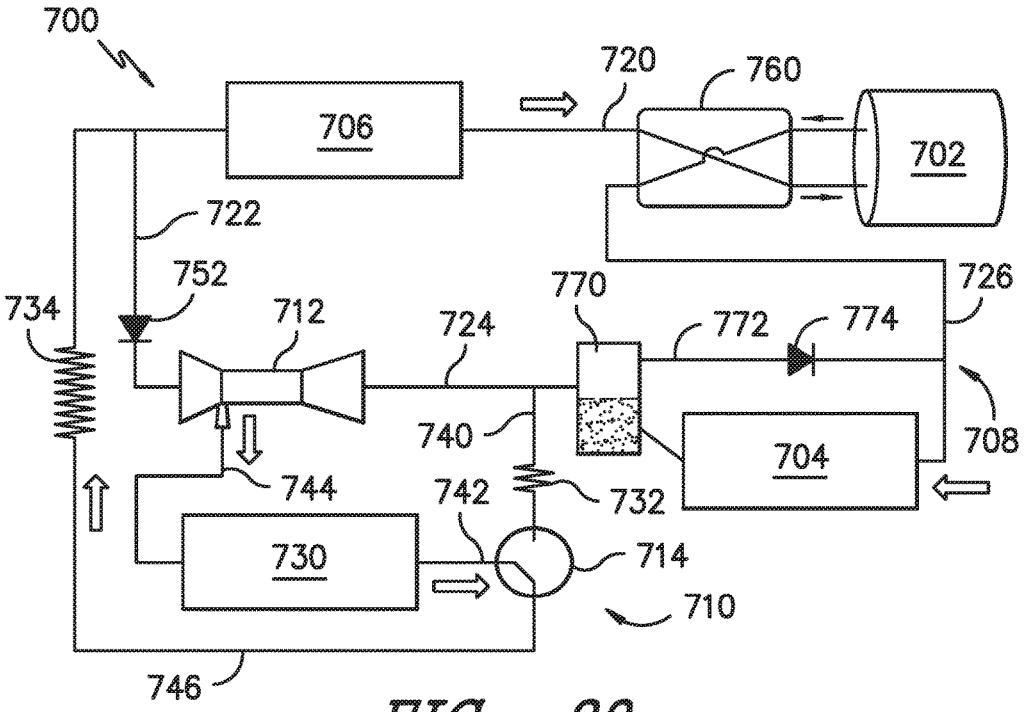

FIGS. 28 and 29 illustrate sealed system 700 according to an alternative exemplary embodiment of the present subject matter, operating in a cooling mode and a heating mode, respectively. Sealed system 700 may be identical to the embodiment illustrated in FIGS. 26 and 27, except that it may further include a phase separator 770.

Phase separator 770 may be coupled to third portion 724 of primary loop 708. As explained above, phase separator 770 is configured for separating liquid refrigerant within phase separator 770 from vapor refrigerant within phase separator 770, e.g., when sealed system 700 is operating in the cooling mode. More specifically, within a casing of phase separator 770, liquid phase refrigerant may collect or pool at a bottom portion of phase separator 770 and vapor phase refrigerant may collect or pool at a top portion of phase separator 770, e.g., due to density differences between the liquid and vapor phase refrigerants. By separating liquid refrigerant from vapor refrigerant, phase separator 770 may improve a performance and/or efficiency of packaged terminal air conditioner unit 100, as discussed above.

Liquid phase refrigerant is routed directly to primary interior coil 704 through third portion 724 of primary loop 708. Phase separator 770 may further include a vapor bypass conduit 772, which extends between and fluidly couples a top portion of phase separator 770 with fourth portion 726 of primary loop 708. In this manner, liquid phase refrigerant in phase separator 770 may pass to primary interior coil 704 while vapor phase refrigerant in phase separator 770 may pass through vapor bypass conduit 772 to compressor 702. A vapor bypass check valve 774 may be coupled to vapor bypass conduit 772, i.e., downstream of phase separator 770 when in the cooling mode. In this manner, vapor bypass check valve 774 prevents the flow of refrigerant back into phase separator 770 from compressor 702.

Notably, sealed system 700, whether configured as illustrated in FIGS. 26 and 27 or as illustrated in FIGS. 28 and 29, exhibits significant performance advantages relative to prior art sealed systems, such as sealed system 150. For example, the use of three-way valve 714 (as opposed to a series of check valves), reverses the flow of refrigerant through secondary interior coil 730 between the cooling modes and heating modes. This means that high-vapor-content refrigerant entering secondary interior coil 730 in the heating mode has to flow through a heat exchanger designed for a liquid input. This could lead to a large pressure drop through secondary interior coil 730. By including three-way valve 714, the relative locations of liquid and vapor within secondary interior coil 730 do not change, regardless of whether sealed system 700 is operating in the heating mode or the cooling mode. This makes it easier to optimize secondary interior coil 730 for optimal sealed system 700 performance in both the heating and cooling modes, and reduces the pressure drop in the heating mode. The addition of phase separator 714 may further reduce the pressure drop in primary interior coil 704 by bypassing the vapor flow.

One skilled in the art will appreciate that sealed systems 150, 200, 300, 400, 500, 600, and 700 are used only for the purposes of explaining aspects of the present subject matter. The components used and the configurations described may be adjusted as needed depending on the application to improve the energy efficiency ratio and performance of the sealed systems. These sealed systems may include additional features or components, and these components may be positioned at any suitable location within the sealed system while remaining within the scope of the present subject matter. Other components and configurations are also possible and within the scope of the present subject matter.

In addition, although refrigerant may be referred to herein as vapor phase or liquid phase refrigerant, one skilled in the art will appreciate that this does not mean that the refrigerant must be entirely in the liquid or vapor phase. Indeed, depending on the refrigerant, operating conditions, and other system parameters, refrigerant at any point in the exemplary sealed systems described herein may be a sub-cooled liquid, a liquid, a liquid-vapor mixture, a vapor, a superheated vapor, or some mixture thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaged terminal air conditioner unit, comprising:

a casing extending between an exterior side portion and an interior side portion;

a compressor positioned within the casing, the compressor operable to compress a refrigerant;

an exterior coil positioned within the casing at the exterior side portion of the casing;

a primary interior coil positioned within the casing at the interior side portion of the casing;

a secondary interior coil positioned within the casing at the interior side portion of the casing;

a reversing valve positioned within the casing, the reversing valve being in fluid communication with the compressor in order to receive compressed refrigerant from the compressor and selectively direct the compressed refrigerant from the compressor;

an ejector configured for combining two or more streams of refrigerant;

a primary loop having a first portion extending between the reversing valve and the exterior coil, a second portion extending between the exterior coil and the ejector, a third portion extending between the ejector and the primary interior coil, and a fourth portion extending between the primary interior coil and the reversing valve;

an auxiliary loop conduit having a first portion extending between the third portion of the primary loop and the secondary interior coil, a second portion extending between the secondary interior coil and the second portion of the primary loop, and a third portion extending between the secondary interior coil and the ejector; and a check valve coupled to the second portion of the auxiliary loop conduit to prevent refrigerant from flowing from the exterior coil into the secondary interior coil.

2. The packaged terminal air conditioner unit of claim 1, further comprising:

a first check valve coupled to the second portion of the primary loop to prevent refrigerant from flowing back into the exterior coil; and a second check valve coupled to the third portion of the primary loop to prevent refrigerant from flowing back into the ejector.

3. The packaged terminal air conditioner unit of claim 1, further comprising a first expansion device coupled to the first portion of the auxiliary loop conduit and a second expansion device coupled to the second portion of the auxiliary loop conduit.

4. The packaged terminal air conditioner unit of claim 3, wherein the first expansion device and the second expansion device are capillary tubes.

5. The packaged terminal air conditioner unit of claim 1, further comprising a phase separator positioned within the casing and coupled to the third portion of the primary loop, the phase separator being configured for separating refrigerant into a liquid refrigerant stream and a vapor refrigerant stream.

6. The packaged terminal air conditioner unit of claim 5, further comprising a vapor bypass conduit extending between the phase separator and the fourth portion of the primary loop, wherein the vapor refrigerant stream flows directly from the phase separator to the compressor through the vapor bypass conduit.

7. The packaged terminal air conditioner unit of claim 6, further comprising a check valve coupled to the vapor bypass conduit to prevent the flow of refrigerant from the compressor to the phase separator.

8. The packaged terminal air conditioner unit of claim 7, wherein the phase separator is configured to provide the liquid refrigerant stream to both the primary interior coil and the secondary interior coil.

9. The packaged terminal air conditioner unit of claim 1, wherein the packaged terminal air conditioner unit is configured such that, in a cooling mode, the reversing valve directs refrigerant directly from the compressor to the exterior coil, and wherein the packaged terminal air conditioner unit is configured such that, in a heating mode, the reversing valve directs refrigerant directly from the compressor to the primary interior coil.

10. The packaged terminal air conditioner unit of claim 9, wherein in the cooling mode, a flow of liquid refrigerant from the exterior coil flows through the ejector, such that the ejector draws in a flow of vapor refrigerant from the secondary interior coil through the third portion of the auxiliary loop conduit into the flow of liquid refrigerant, and a combined flow of liquid and vapor refrigerant flows out of the ejector toward the primary interior coil along the third portion of the primary loop.

11. A packaged terminal air conditioner unit, comprising:

a casing extending between an exterior side portion and an interior side portion;

a compressor positioned within the casing, the compressor operable to compress a refrigerant;

an exterior coil positioned within the casing at the exterior side portion of the casing;

a primary interior coil positioned within the casing at the interior side portion of the casing;

a secondary interior coil positioned within the casing at the interior side portion of the casing;

a reversing valve positioned within the casing, the reversing valve being in fluid communication with the compressor in order to receive compressed refrigerant from the compressor and selectively direct the compressed refrigerant from the compressor;

an ejector configured for combining two or more streams of refrigerant;

a primary loop having a first portion extending between the reversing valve and the exterior coil, a second portion extending between the exterior coil and the ejector, a third portion extending between the ejector and the primary interior coil, and a fourth portion extending between the primary interior coil and the reversing valve; and an auxiliary loop conduit having a first portion extending between the third portion of the primary loop and the secondary interior coil, and a second portion extending between the secondary interior coil and the ejector; and a first expansion device coupled to the first portion of the auxiliary loop conduit, wherein the second portion of the primary loop comprises a check valve configured to prevent the flow of refrigerant back in to the exterior coil and a second expansion device plumbed in parallel.

12. The packaged terminal air conditioner unit of claim 11, further comprising a check valve coupled to the third portion of the primary loop to prevent refrigerant from flowing back into the ejector.

13. The packaged terminal air conditioner unit of claim 11, further comprising:

a phase separator positioned within the casing and coupled to the third portion of the primary loop, the phase separator being configured for separating refrigerant into a liquid refrigerant stream and a vapor refrigerant stream; and a vapor bypass conduit extending between the phase separator and the fourth portion of the primary loop, wherein the vapor refrigerant stream flows directly from the phase separator to the compressor through the vapor bypass conduit.

* * * * *